US011311788B1

(12) United States Patent
Bourassa-Fulop

(10) Patent No.: US 11,311,788 B1
(45) Date of Patent: Apr. 26, 2022

(54) TOOL FOR MARTIAL ARTS TRAINING

(71) Applicant: Effective Martial Arts (9303-3017 Québec Inc.), Pointe-Claire (CA)

(72) Inventor: Patrick Bourassa-Fulop, Pointe-Claire (CA)

(73) Assignee: Effective Martial Arts (9303-3017 Quebec Inc.), Quebec (CA)

( * ) Notice: Subject to any disclaimer, the term of this patent is extended or adjusted under 35 U.S.C. 154(b) by 0 days.

(21) Appl. No.: 17/535,085

(22) Filed: Nov. 24, 2021

(51) Int. Cl.
*A63B 69/34* (2006.01)

(52) U.S. Cl.
CPC ..... *A63B 69/345* (2013.01); *A63B 2209/00* (2013.01); *A63B 2214/00* (2020.08)

(58) Field of Classification Search
CPC ..... A63B 69/34–345; A63B 2209/00; A63B 2214/00
See application file for complete search history.

(56) References Cited

U.S. PATENT DOCUMENTS

| | | | | |
|---|---|---|---|---|
| 9,050,514 | B1 | 6/2015 | Mirza | |
| 10,561,920 | B2 * | 2/2020 | Wagner | A63B 69/345 |
| 2008/0026917 | A1 * | 1/2008 | Campana | A63B 69/34 482/83 |
| 2012/0094788 | A1 * | 4/2012 | Hartigan | A63B 69/002 473/445 |
| 2012/0238414 | A1 * | 9/2012 | Blaies | A63B 69/0053 482/83 |
| 2013/0137554 | A1 * | 5/2013 | Knight | A63B 69/345 482/85 |
| 2013/0296141 | A1 * | 11/2013 | Partlo | A63B 71/0622 482/84 |
| 2018/0065016 | A1 * | 3/2018 | Hall | A63B 24/0087 |
| 2018/0233068 | A1 * | 8/2018 | Kraus | A63B 69/345 |

FOREIGN PATENT DOCUMENTS

GB 2501133 A 10/2013

OTHER PUBLICATIONS https://www.amazon.com/Jayefo-Beast-Grappling-Dummy-5-FEET/dp/B07VR955PV/ (First date available for sale: Jul. 29, 2019) (Year: 2019).*

* cited by examiner

*Primary Examiner* — Andrew S Lo
(74) *Attorney, Agent, or Firm* — Boyle Fredrickson, S.C.

(57) ABSTRACT

A grappling dummy of humanoid shape is described. The grappling dummy offers a strategically sound and versatile posture for more realistic martial arts training by holding a realistic guard position. The dummy is comprised of an envelope, to be filled with any material to give it the desired weight and consistency. When filled, the tensile strength of the envelope and filling allow the limbs of the grappling dummy to retract to their resting guard position when extended. Due to the dummy's resting posture with knees above the hip line and elbows in front of and covering the torso, this grappling dummy may be placed in a variety of positions including supine, seated, and turtle, and thus offers a more versatile and realistic training experience.

20 Claims, 24 Drawing Sheets

TOOL FOR MARTIAL ARTS TRAINING

TECHNICAL FIELD

This invention relates generally to a training tool and more specifically to a tool used for grappling and/or martial arts training.

BACKGROUND

The art of grappling commonly refers to the aspect of hand-to-hand combat in which one or both partners are on the ground, in a variety of relative positions, and are fighting for control, as well as to inflict damage to the opponent. These techniques are most commonly known in Brazilian Jiu-Jitsu (BJJ) as well as Mixed Martial Arts (MMA). In such sports, techniques are used to gain advantage over the opponent and force submission. Training on such techniques is usually achieved by sparring with real live partners/opponents or through the use of training tools such as grappling dummies.

Humanoid size grappling dummies are known in the industry. They are used for training purposes in various martial arts. Many grappling dummies known in the field have inadequate leg or arm positions to provide either a realistic defensive or attack position. Some grappling dummies simply lie flat on the ground with chest and limbs exposed. Other grappling dummies allow for pre-setting the limbs of the dummy but are expensive to manufacture and are prone to breakage as well as require regular maintenance due to the complexity of the parts used to make such dummies. There is a desire in the field for a grappling dummy that address at least some of these deficiencies.

SUMMARY OF THE INVENTION

The current invention has several aspects. In one aspect of the invention, humanoid shaped grappling dummy envelope for martial arts training is described. when the envelope is filled with filling material, it forms a non-mechanical grappling dummy, which has a torso defining a torso plane and a hip line in the torso plane. It is also has a head coupled to the torso, where the head is slightly tilted forward in relation to the plane of the torso. The dummy also has two arms, where each of the two arms have an upper arm section extending from the torso, a lower arm section and an elbow between and connecting the upper arm section and the lower arm section. The dummy further has two legs coupled to the torso, where each of the two legs have an upper leg section extending from the torso, a lower leg section and a knee between and connecting the upper leg section and the lower leg section. The non-mechanical grappling dummy described is configured to have a realistic guard position and each of the torso, head, two arms and two legs are flexible, resilient to bending and retract to the guard position after bending.

In a related embodiment of the invention, the realistic guard position of the non-mechanical grappling dummy comprises one or more of an upper guard position and a lower guard position. The upper guard position is defined by the two arms being configured to be in front of the torso with the elbow for each of the two arms positioned in front of and covering the torso. Such elbows would be in this case pointing away from the head. The lower guard position is defined by the knee for each of the two legs being configured to be positioned in a plane different from the plane of the torso, with the knees bent to be closer to the head and passing the hip line and with the lower leg section pointing away from the torso.

In a further related embodiment, the upper guard position of the non-mechanical grappling guard dummy is further defined to have the lower arm section for each of the two arms positioned to cover the torso and the head. In another embodiment, the lower arm section for each of the two arms may be extended away from the torse and towards an opponent.

In another related embodiment of the invention, when the upper guard and the lower guard are present in the formed in the non-mechanical dummy, the distance between the two elbows is smaller than the distance between the two knees such that the knees are wider apart and are slightly outside the chest area and the elbows are within the chest area and are in a positioned to have the arms cover the chest area.

In a related embodiment of the invention, the elbow and knee on each side of the dummy are close to one another. In other embodiments, the elbow and the knee on each side of the dummy are touching one another.

The grappling dummy that is formed from the envelope described above has the ability to have a stable posture when positioned in any of the supine, seated or turtle positions. As such, many grappling techniques may be practiced with this dummy.

In some related embodiments of the invention, the dummy may be filled with the same material for all of its parts. In other aspects, different filling material may be used. For example, in some embodiments, light weight material with expanding characteristics may be used to fill at least part of the lower arms and lower legs. Doing this allows the hands to maintain its guard position without being affected too much by gravity in the supine position. In some embodiments, the material used to fill at least part of the lower arms and lower legs may be the same or different from the material used to fill the rest of parts of the dummy.

The combination of the type of material used to fabricate the envelope of the grappling dummy and the design into which the material is fabricated as well as the material used for filling the envelope to form the grappling dummy all contribute to having the filled dummy hold a realistic and technically proper grappling guard position in any of the supine, seater or turtle positions. These factors also allow the limbs and joints of the filled dummy to be flexibility. They further allow the dummy to be resilient such that when any of the limbs or joints are bent, such limb or joint will retract back to the guard position, which is the resting positing for the dummy, after the force causing the bending is removed.

In some related embodiments of the invention, the ranger of motion and the flexibility of the dummy's limbs and joints are described to correspond to that of a natural person. In some embodiments of the invention, such joints can be bent past the breaking point of a joint corresponding to a natural person.

In some related embodiments of the invention, the dummy envelope comes with an opening that may be positioned anywhere on the envelope to allow the user to introduce stuffing material into the dummy and fill each part of the envelope through that opening. In some related embodiments, this opening may be closed by an assembly to secure the filling inside the dummy. Different assemblies known in the art may be used for this purpose.

Another aspect of the invention describes a method of making a grappling dummy for martial arts training. The method includes obtaining an envelope having a humanoid shape and filling such envelope with filling material in order to form a non-mechanical grappling dummy. This dummy, when filled will have the characteristics and features of the non-mechanical grappling dummy described in the first aspect. The method is also includes the steps of configuring the non-mechanical grappling dummy to have a realistic guard position, wherein each of the torso, head, two arms and two legs are flexible, resilient to bending and retract to the guard position after bending.

In a related embodiment, the method further includes the step of configuring the two arms to have a resting posting, where the two arms are positioned in front of the torso with the elbow for each of the two arms positioned in front of and covering the torso. Another related method would further include configuring the two legs to have a resting position, where the two legs are positioned in a plane different from the plane of the torso, with the knees bent to be closer to the head and passing the hip line and with the lower leg section pointing away from the torso. In some embodiments, both the arms and the legs are configured as described above. In other embodiments, only the two arms or the two legs are configured as described.

In a related embodiment, the method further includes the step of filling at least part of each of the two lower arms and at least part of each of the two lower legs with filling material having a light weight and expandable characteristics.

In another related embodiment, the method further includes configuring the two arms, two legs, head and torso to have a range of motion and flexibility corresponding to a natural person. In other embodiments, the configuration may be such that the range of motion and flexibility of the limbs and joints exceed that which corresponds to the flexibility and range of motion of a natural person's limbs and joints and it could be even par the breaking point.

Another aspect of the invention describes a method of training in martial arts. The method includes obtaining a non-mechanical grappling dummy as described in the first aspect, positioning the non-mechanical grappling dummy in any one of a supine, a seated or a turtle positions; and using the non-mechanical grappling dummy to practice realistic grappling techniques.

Other aspects and embodiments of the invention will be apparent as will be shown in the detailed description of the invention.

BRIEF DESCRIPTION OF THE DRAWINGS

The accompanying drawings illustrate non-limiting example embodiments of the invention.

DETAILED DESCRIPTION

Figure 1:
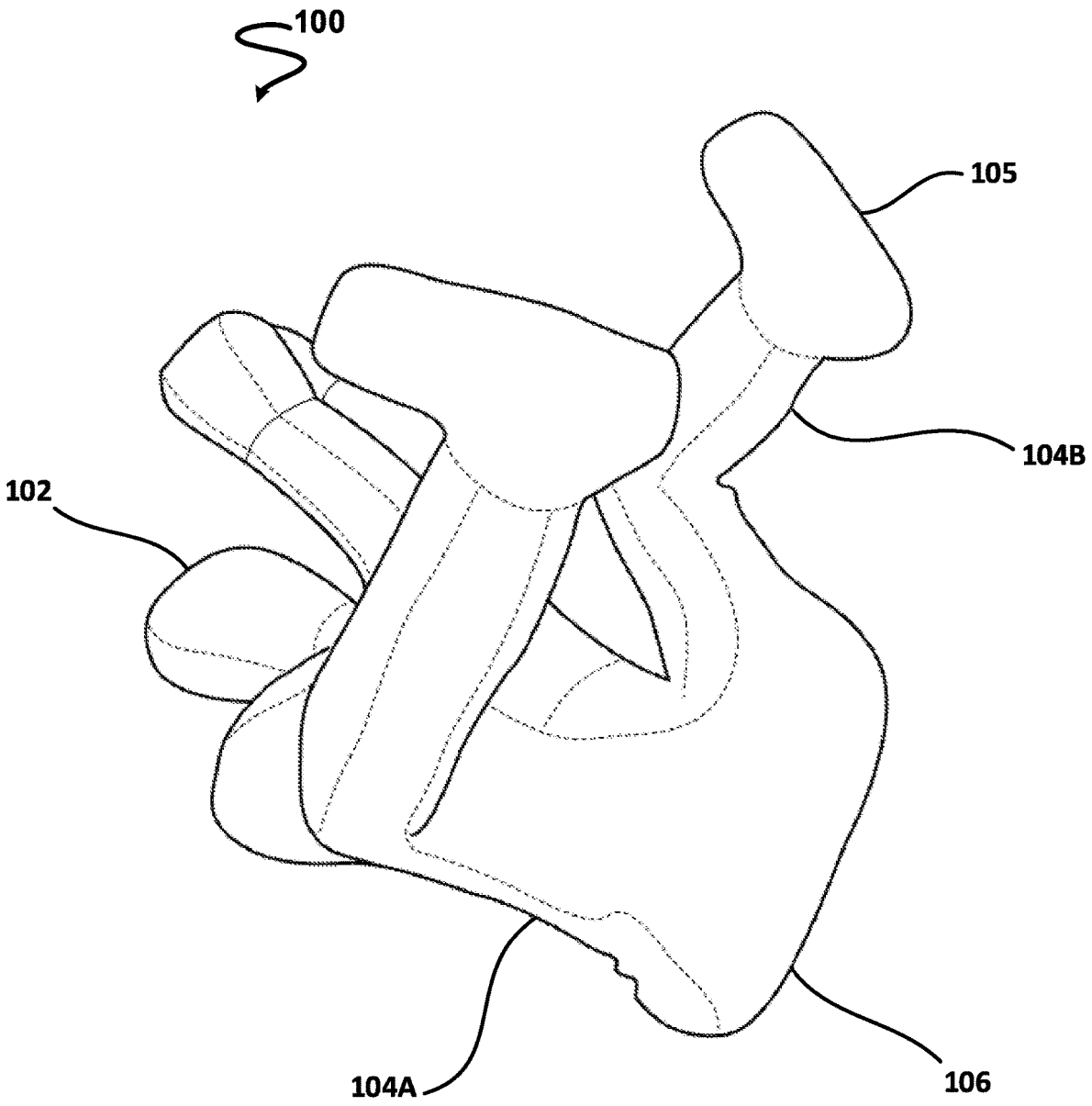
FIG. 1 shows a perspective view of a grappling dummy in a supine position according to an embodiment of the current invention.

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense. The use of same reference numbers in different instances in the description and figures may indicate similar or identical items.

Although there are many grappling dummies in the field, surprisingly, most are not designed to hold a sound defensive grappling posture. Most grappling dummies created to date make the grave tactical mistake of exposing their chest as well as their limbs, making guard passing quite unrealistic, and joint locks all too easy. Non-mechanical grappling dummies are usually designed to lay flat on their backs with feet on the ground, or be in an upright kneeling stance, with no consideration for chest or limb exposure. Some grappling dummies introduce many mechanical parts, including metal plates joined by tension mechanisms or springs, to allow for the positioning of the joints and limbs. However, such mechanical parts are prone to fail, require regular maintenance and cause the manufacturing of the dummy and hence the overall price to be costly.

The current invention presents a non-mechanical tool for training and more specifically a grappling dummy of humanoid shape that offers a strategically sound and versatile posture for more realistic martial arts training. This is achieved by having the dummy simulate a training partner that is able to hold a proper guard position and to default to such position during training without the need for internal or external mechanical parts. As such, the current invention provides a grappling dummy that allows for realistic training due to the dummy holding a proper guard position, the flexibility of its limbs and the resilience of such limbs to bending during training as well as the retention (or retraction) of such limbs to the proper guard position after being bent without the need for any mechanical parts to achieve such result.

In grappling, the "guard" or "guard position" is generally defined as a sound defensive posture adopted from bottom position on the ground, to control an opponent. There are many possible guard positions known in the field and they may be generally classified into seated, supine, and turtle postures. What they all have in common is the knees are generally in front of the chest, with the knees being above the hip line, allowing for use of the legs offensively and defensively. This is akin to having one's hands up in boxing.

FIGS. 1 to 7 show multiple views of a grappling dummy 100 in a supine position according to an exemplary embodiment of the invention. FIGS. 8 to 15 show the grappling dummy 100 in the seated position. FIGS. 16 to 21 show the grappling dummy 100 in the turtle position. The grappling dummy 100 is shown to have a humanoid form with a torso or chest area 101, a head 102, arms 103 and legs 104. Grappling dummy 100 is shown to be devoid of any mechanical parts. The head 102 is shown to be tilted forward in relation to the plane of the torso 101. Such positing of the head 102 is shown to resemble a realistic defensive grappling posture.

Arms 103 are shown to have an upper arm section 103A and a lower arm section 103B, where the connection between the two sections defines an elbow section. Arm 103 is configured to have a default upper guard position, where the arms 103 are in front of the chest 101, the elbows are configured to be above and covering the chest area 101 and the upper arms 103B raised above the elbow line to provide protection to the chest area 101 and the head 102. Such configuration may also be described as elbows pointing towards the hip line and the lower arms forming a frame in front of the chest area 101 and the head 102. In some embodiments, the lower arms 103B may be extended away from and in front of the chest area 101 to provide a defensive distance between a trainee and both of the head 102 and chest area 101 of the grappling dummy 100.

The grappling dummy 100 in FIGS. 1-7 is shown to have fists at the end of the lower arms 103B. In some embodiments, such feature is considered optional and may not be present.

The legs 104 in FIG. 1 are shows to have an upper leg section 104A and a lower leg section 104B, where the connection between the two sections defines a knee section of the humanoid dummy 100. Legs 104 are configured to also have a default lower guard position. In such position, legs 104 are shown to be generally in front of the chest area 101, with the knees being kept close to the chest area 101 and close to the armpit area of the grappling dummy 100. The knees are also shown to be above the hip line of the grappling dummy 100. It is these features that allow for a realistic lower guard position in the grappling dummy 100. The knees in FIG. 1 are further shown to be close to the elbows. As the grappling dummy is humanoid in shape, the distance between the knees is shown to be wider than the distance between the elbows. In some embodiments, the knee of each side of the grappling dummy 100 may be connected to the elbow of the same side of the grappling dummy 100. Connected in this context is to be understood as having contact with or touching one another.

Figure 4:
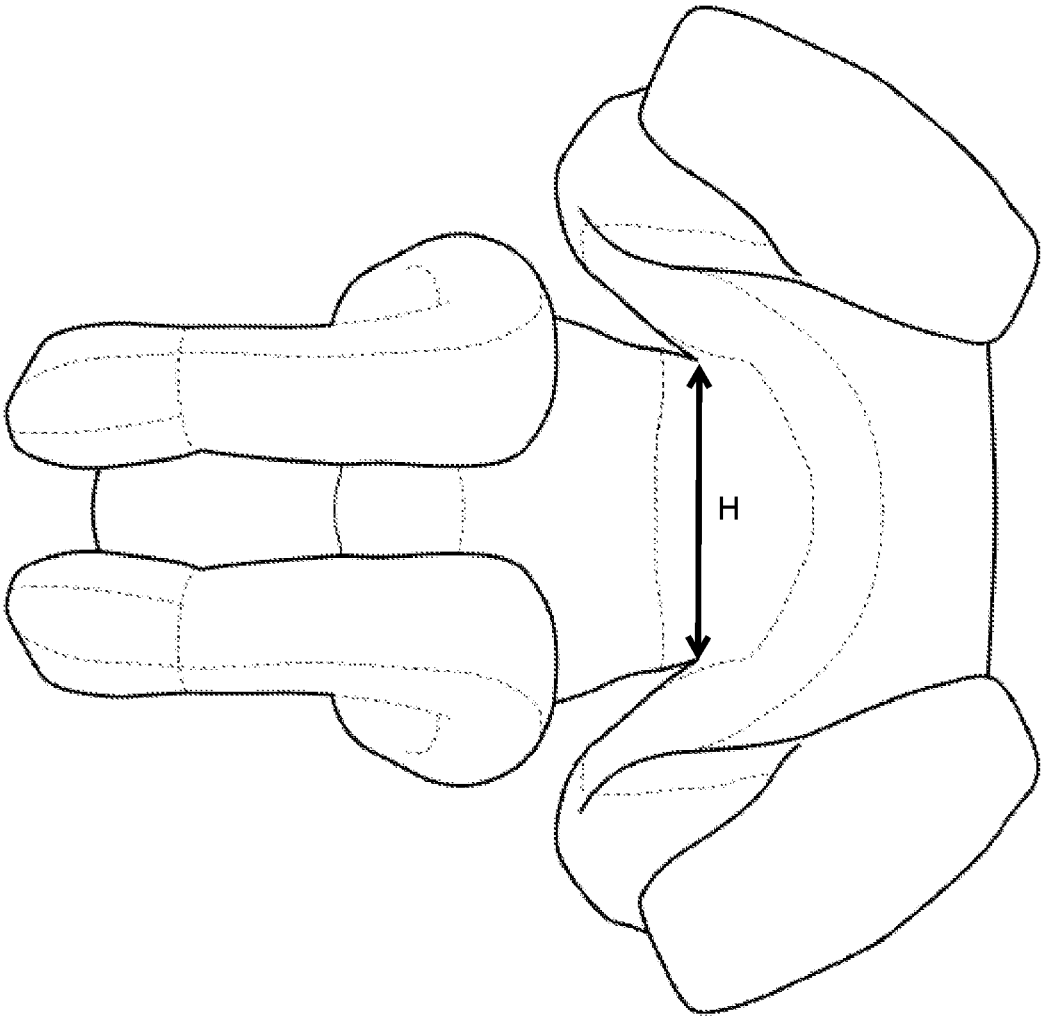
FIG. 4 shows a top view of the grappling dummy in FIG. 1.
Figure 5:
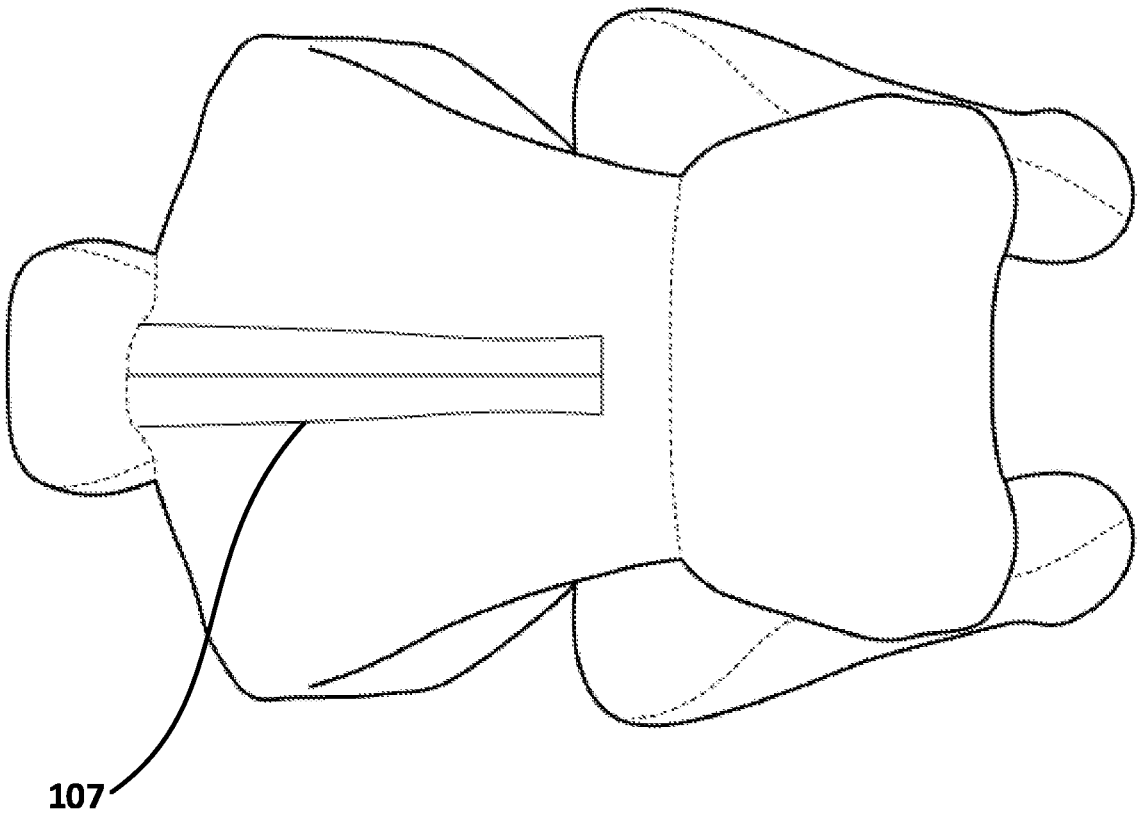
FIG. 5 shows a bottom view of the grappling dummy in FIG. 1.
Figure 6:
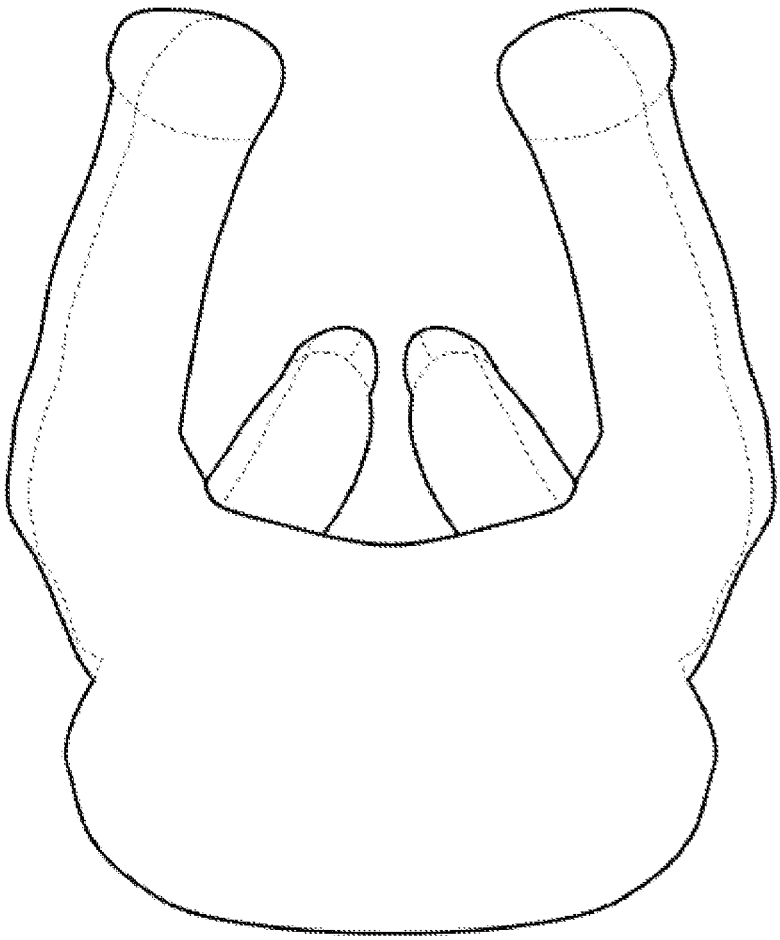
FIG. 6 shows a back view of the grappling dummy in FIG. 1.
Figure 7:
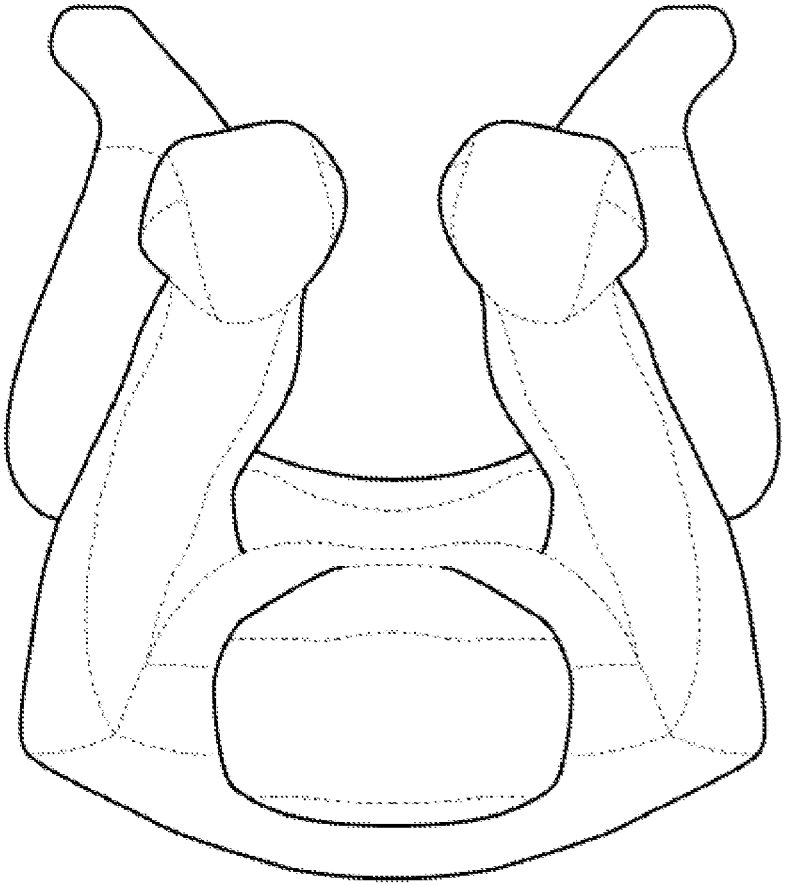
FIG. 7 shows a front view of the grappling dummy in FIG. 1
Figure 8:
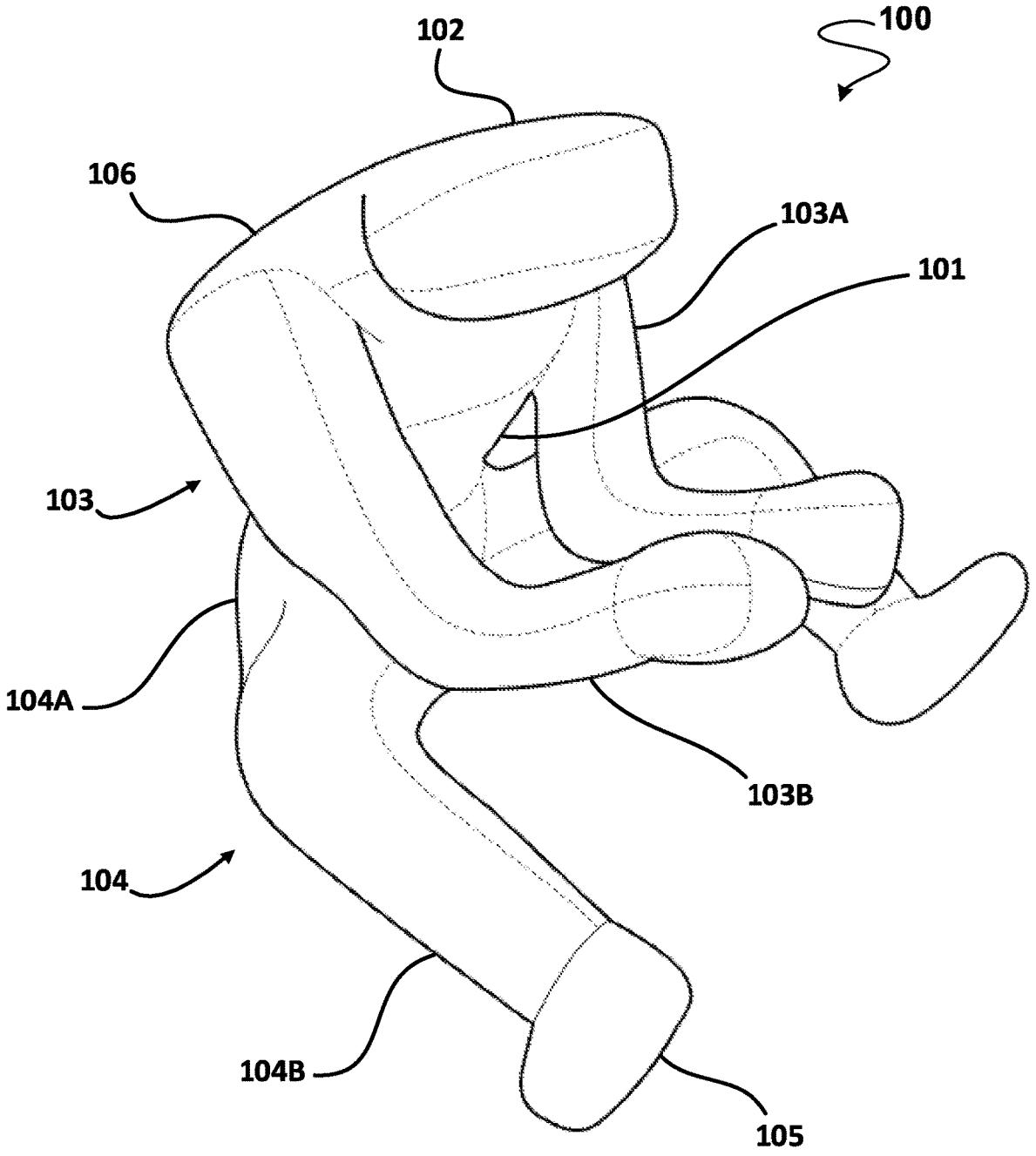
FIG. 8 shows a perspective view of a grappling dummy in a seated position according to an embodiment of the current invention.
Figure 9:
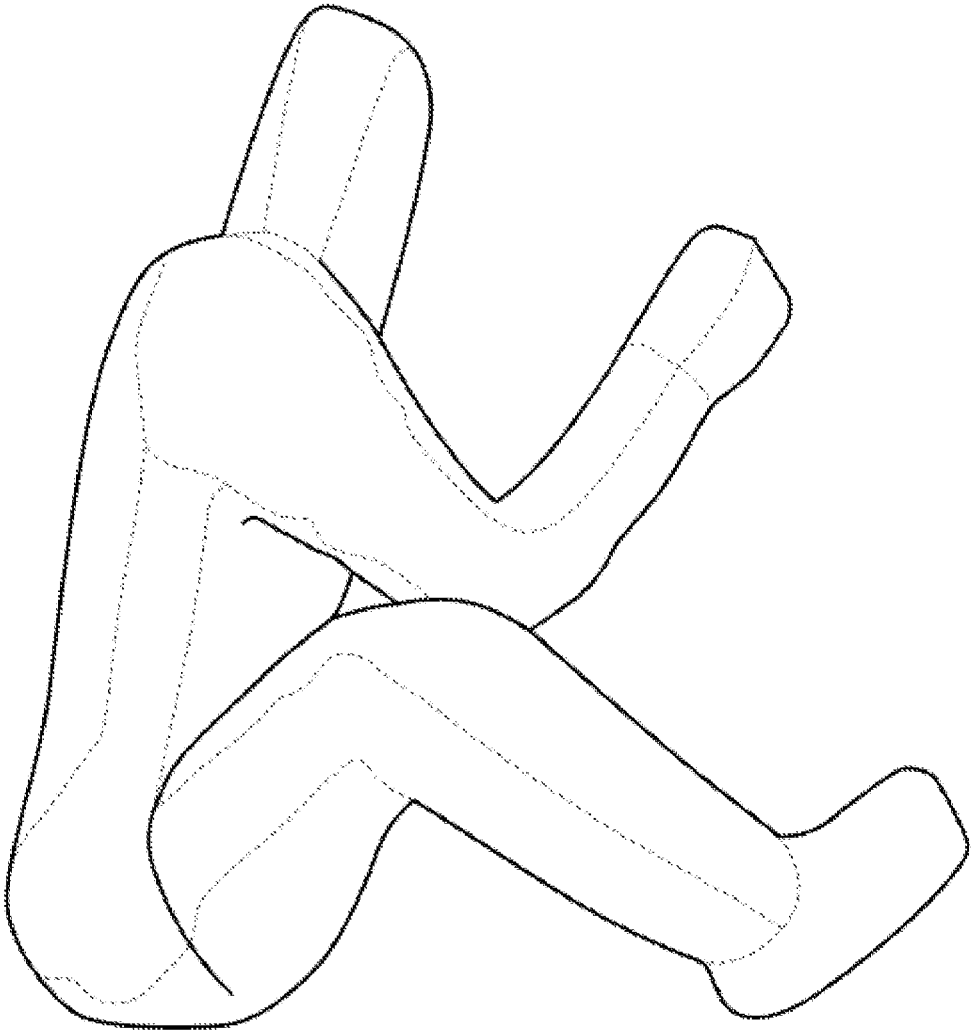
FIG. 9 shows a right-side view of the grappling dummy in FIG. 8.
Figure 10:
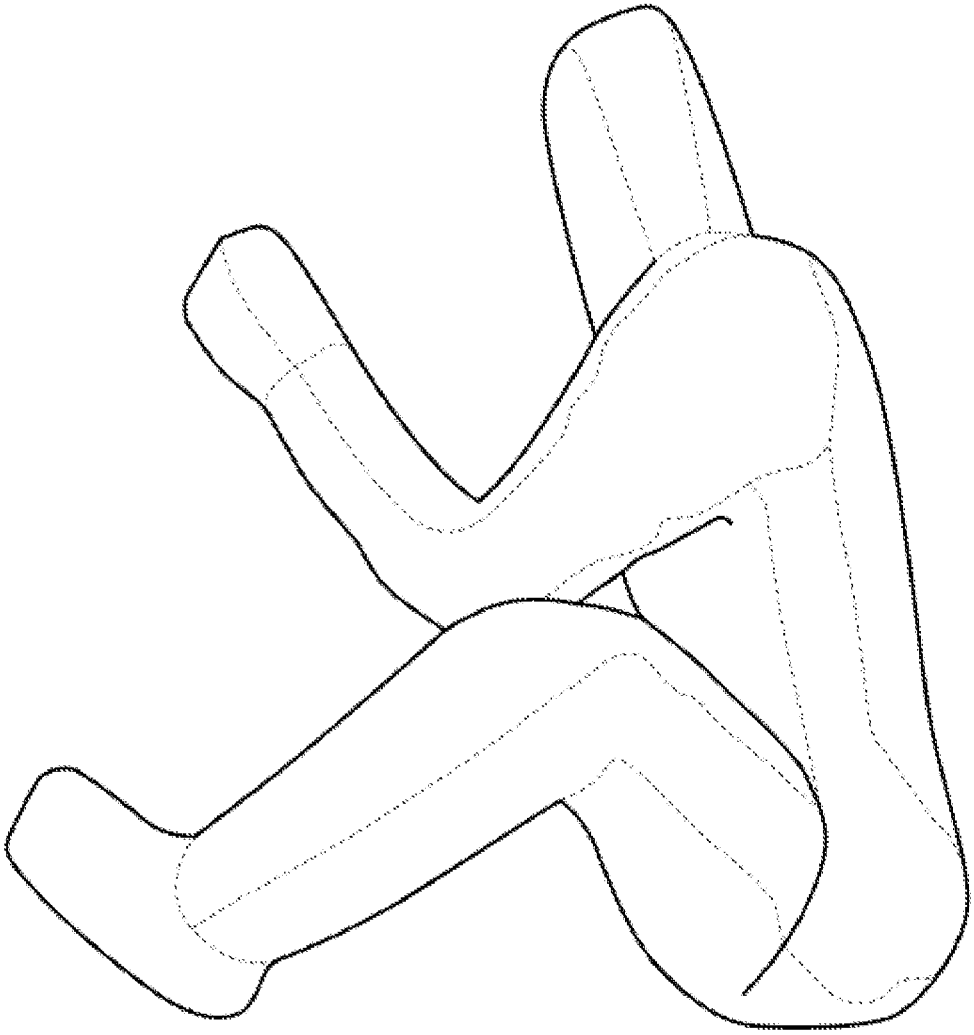
FIG. 10 shows a left-side view of the grappling dummy in FIG. 8
Figure 11:
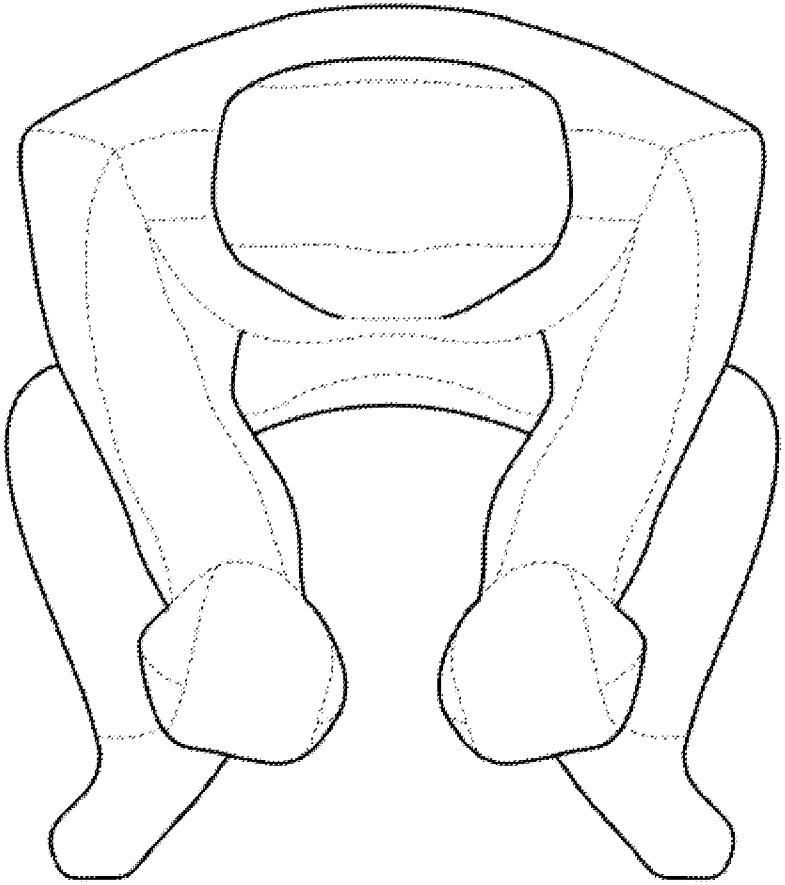
FIG. 11 shows a top view of the grappling dummy in FIG. 8.
Figure 12:
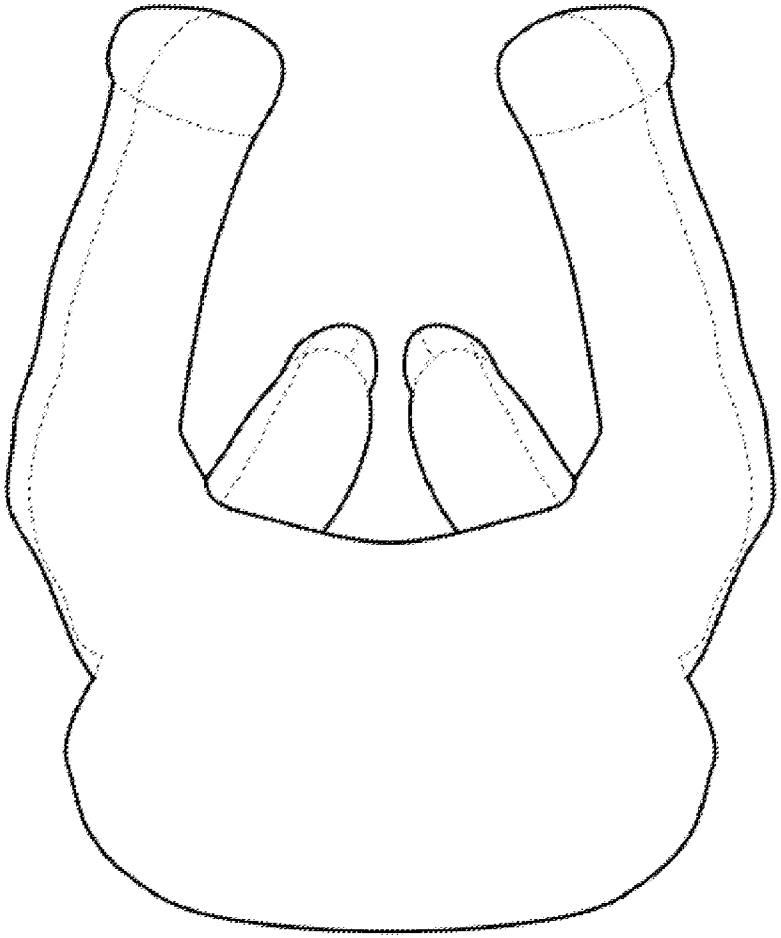
FIG. 12 shows a bottom view of the grappling dummy in FIG. 8.
Figure 13:
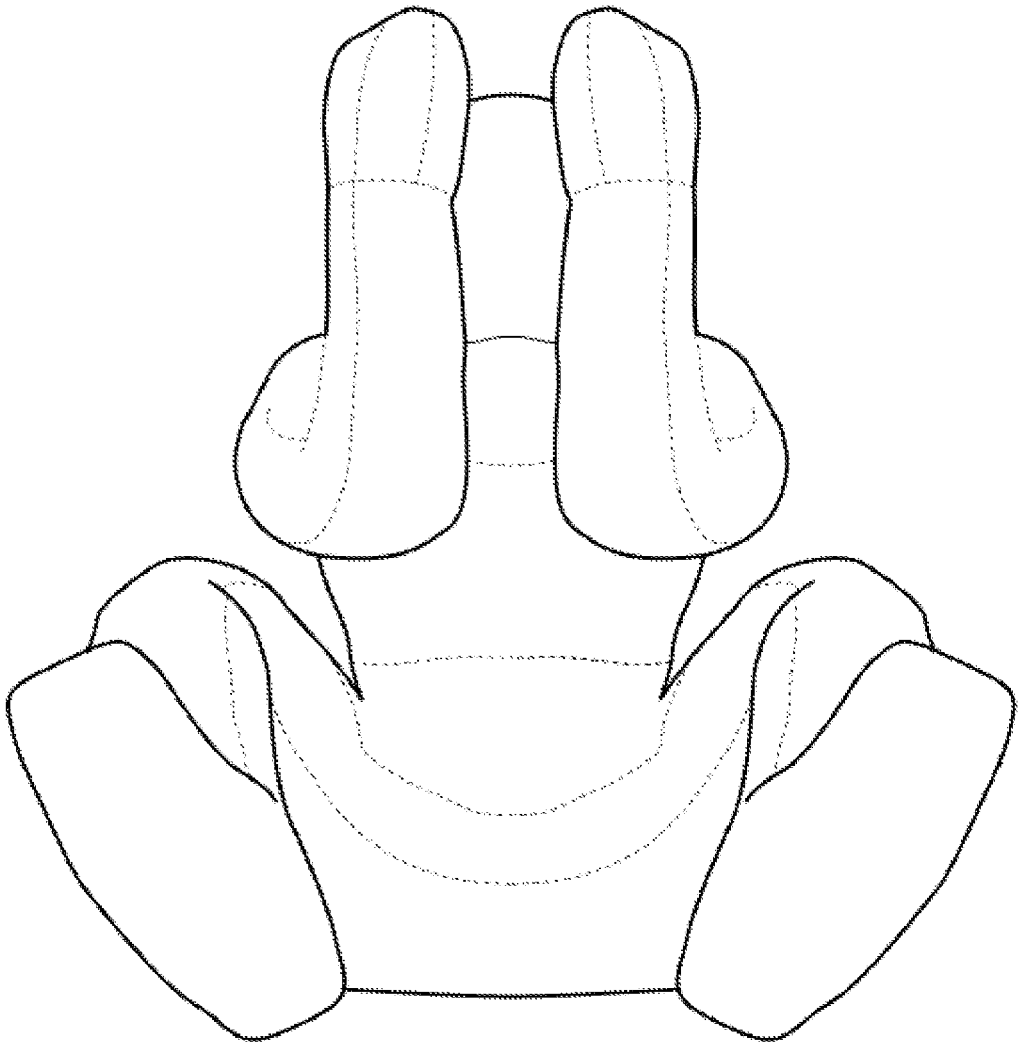
FIG. 13 shows a front view of the grappling dummy in FIG. 8.
Figure 14:
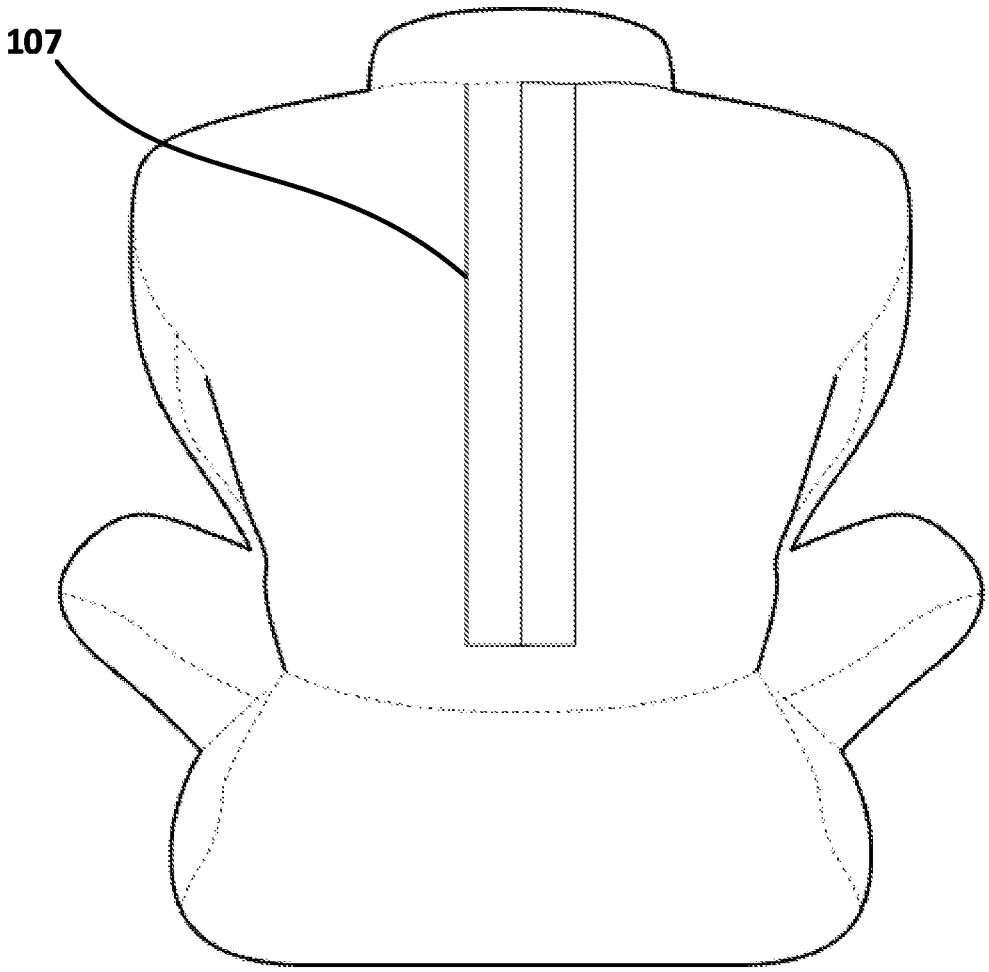
FIG. 14 shows a back view of the grappling dummy in FIG. 8
Figure 15:
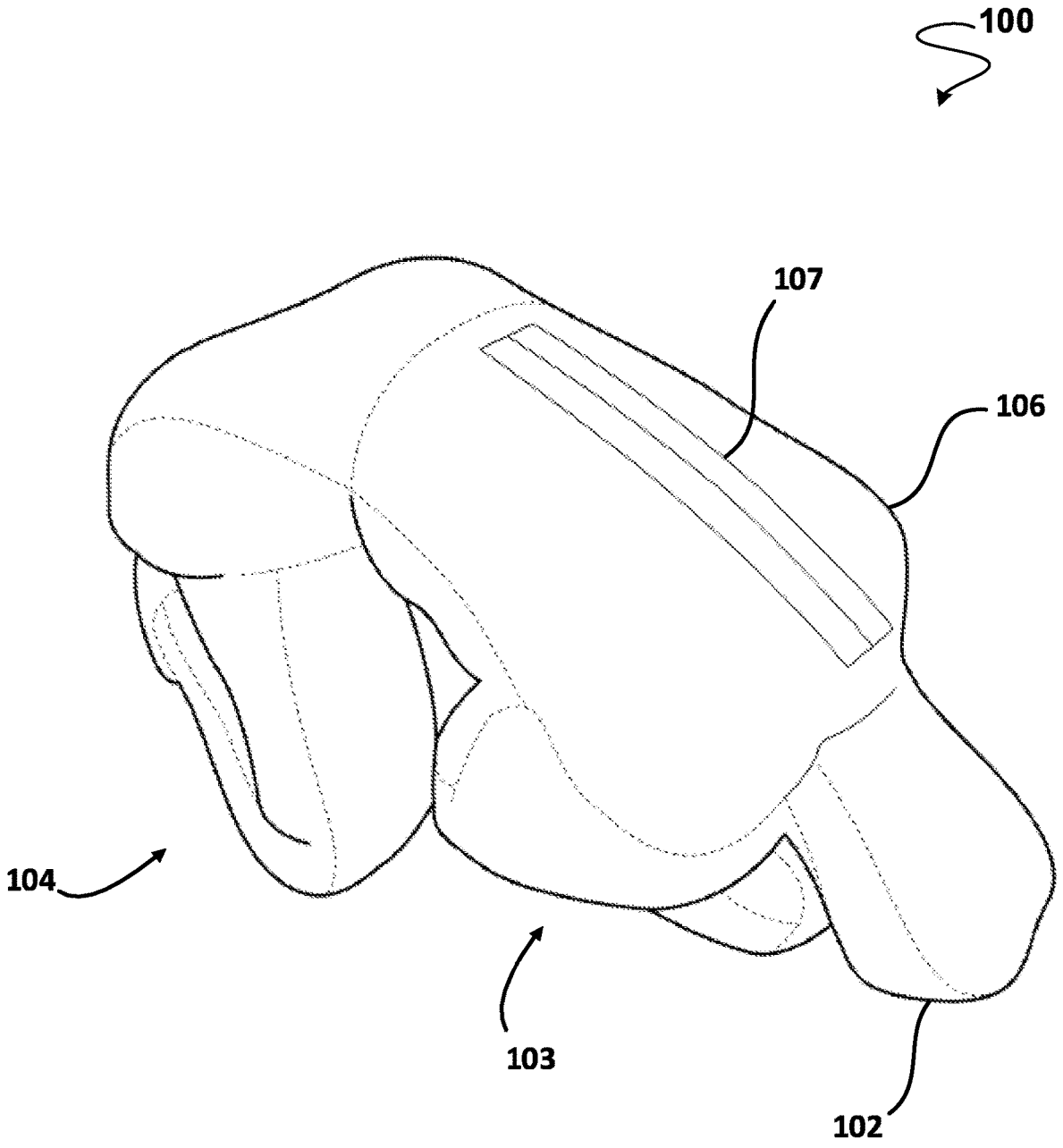
FIG. 15 shows a perspective view of a grappling dummy in a turtle position according to an embodiment of the current invention.
Figure 16:
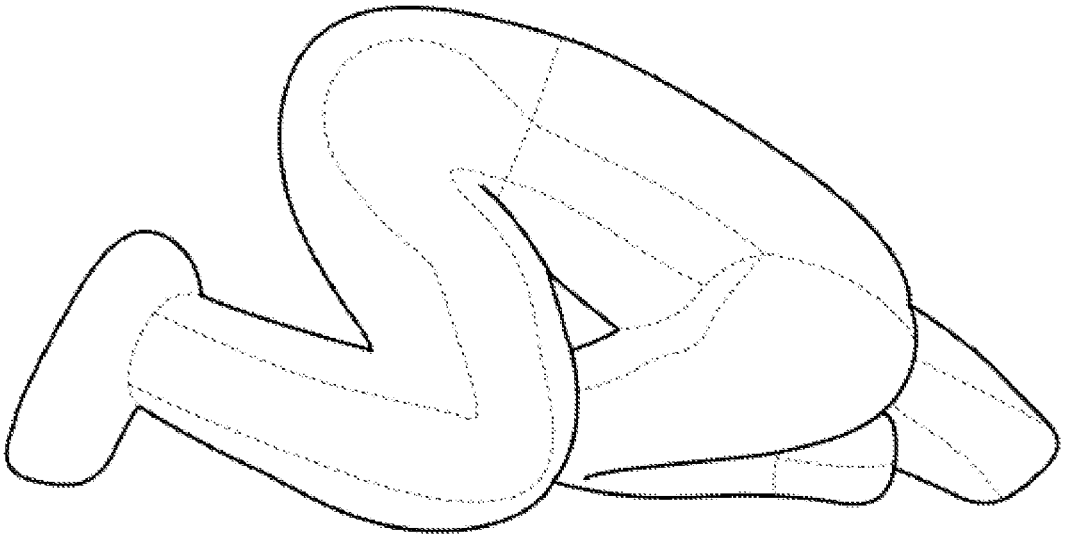
FIG. 16 shows a right-side view of the grappling dummy in FIG. 15.
Figure 17:
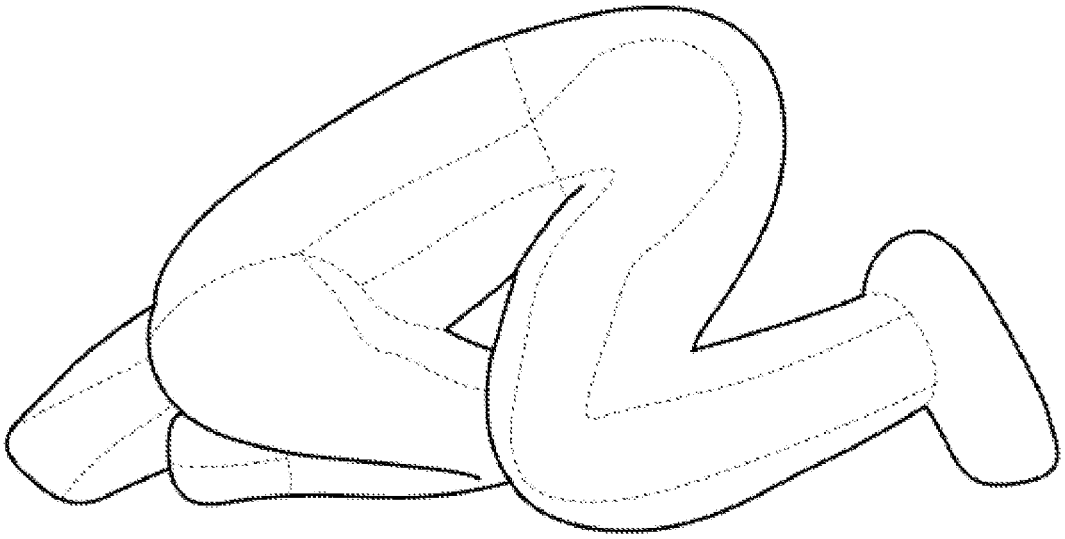
FIG. 17 shows a left-side view of the grappling dummy in FIG. 15
Figure 18:
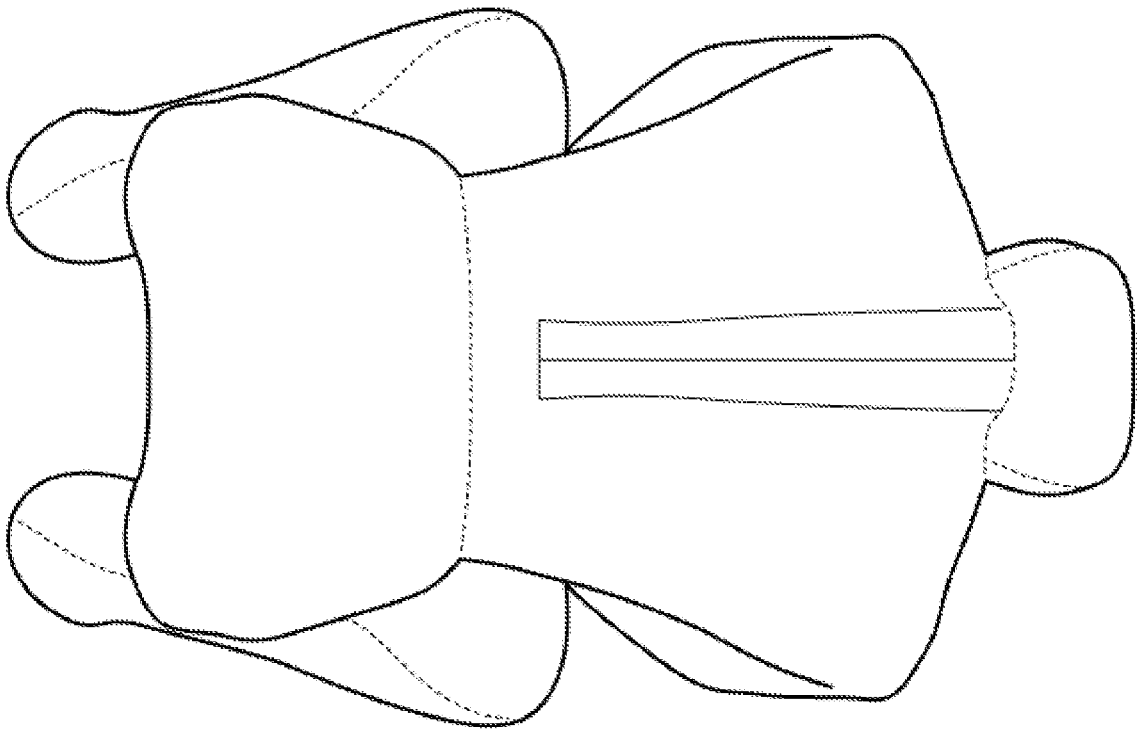
FIG. 18 shows a top view of the grappling dummy in FIG. 15.
Figure 19:
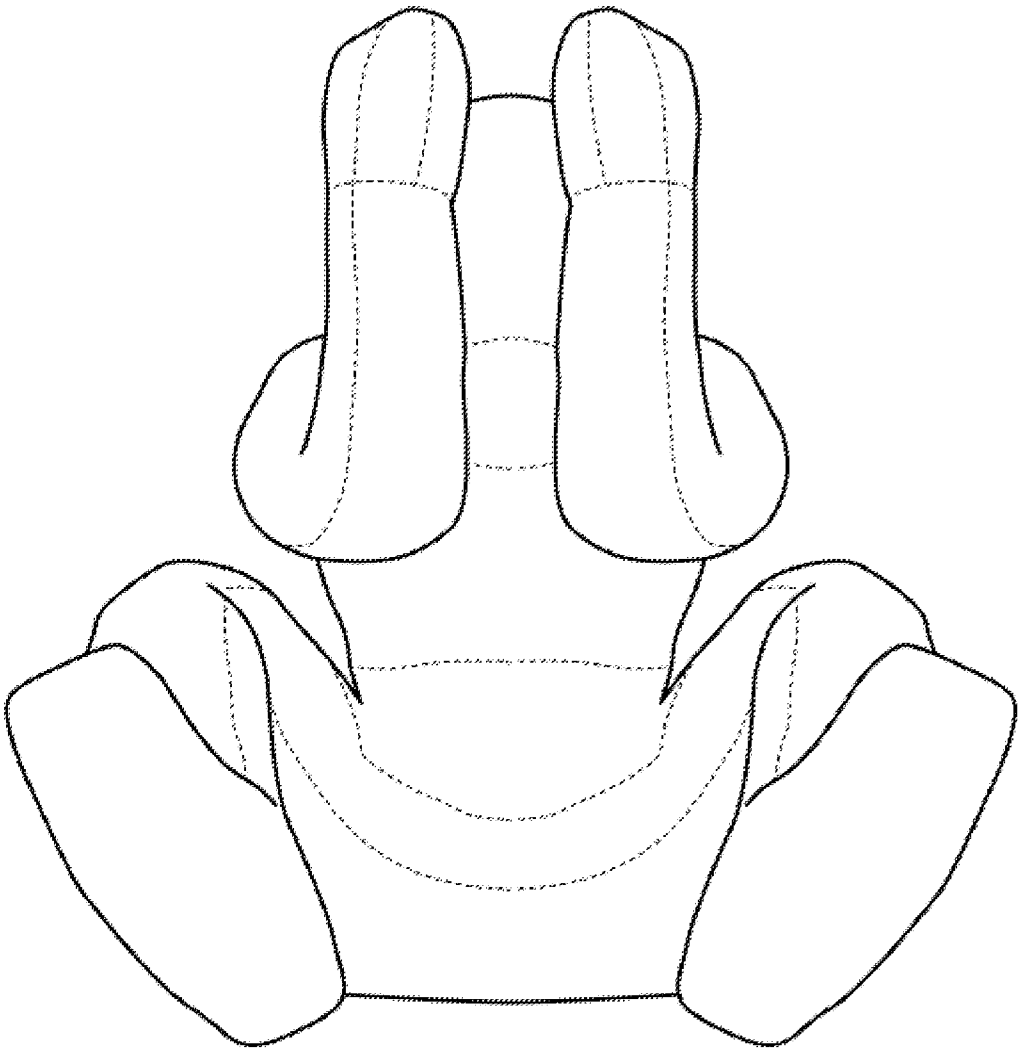
FIG. 19 shows a bottom view of the grappling dummy in FIG. 15.
Figure 20:
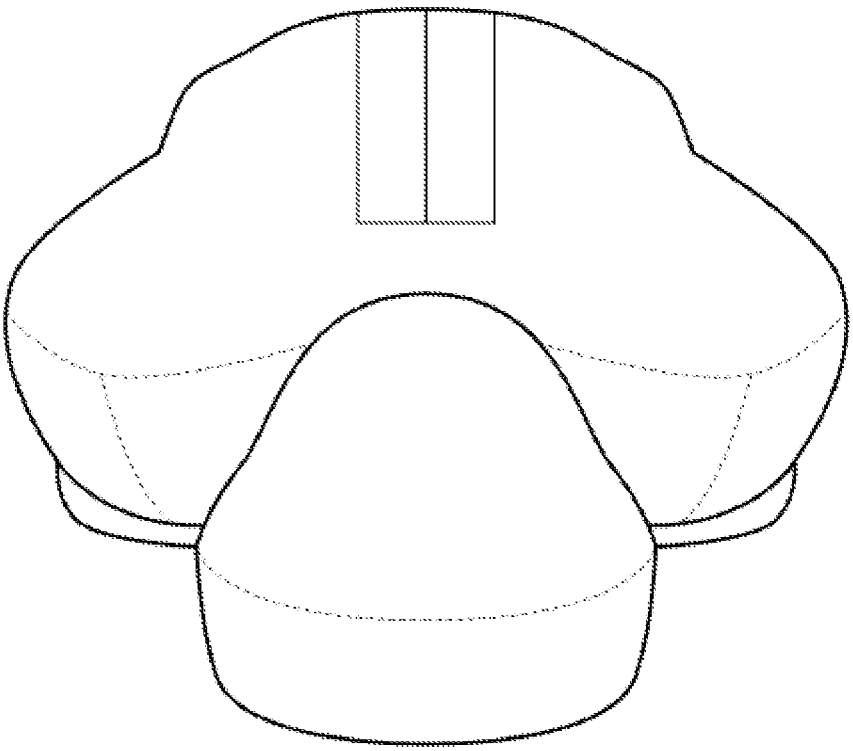
FIG. 20 shows a front view of the grappling dummy in FIG. 15.
Figure 21:
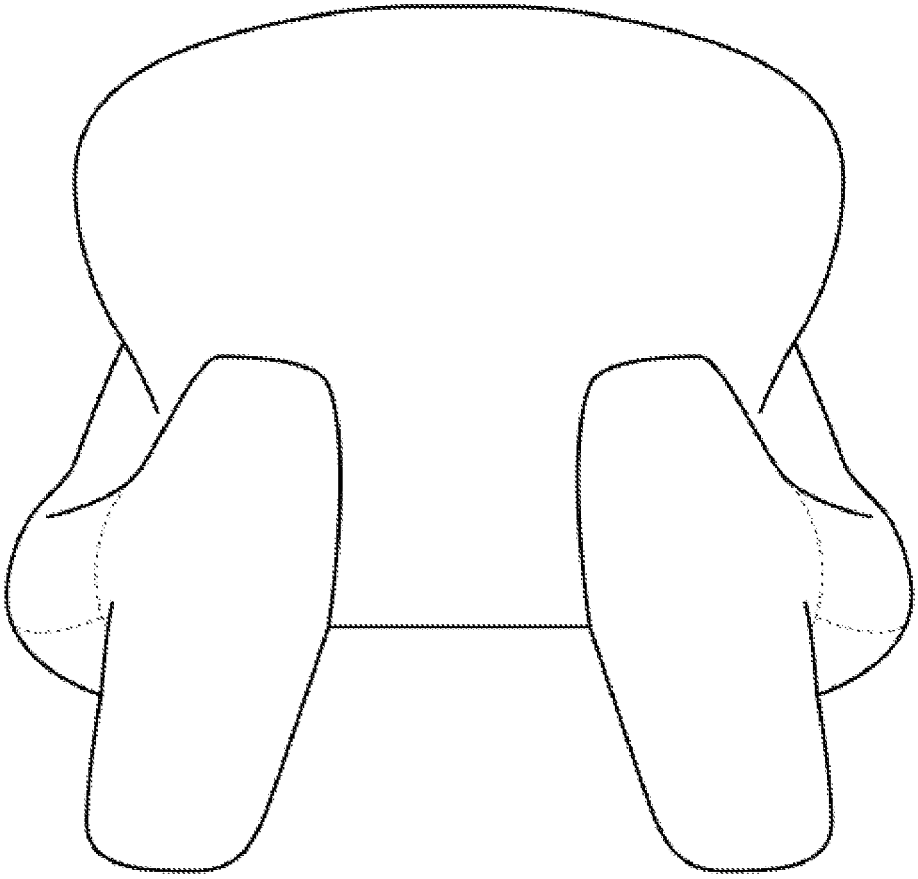
FIG. 21 shows a back view of the grappling dummy in FIG. 15

Line H in FIG. 4 show the hip line that connects the two hips of the grappling dummy 100. As shown in FIG. 4, the knees are position in the lower guard to be in a plane different from the plane of the torso 101. The knees are also shown to be bent such that their position is closer to the head area 102 compared to a natural limb position of a humanoid shape. The knees are further shown to pass the hip line H in such position. Therefore, depending on the orientation of the grappling dummy 100, such position of the knees can be described as above the hip line H in a supine position, or in front of the hip line H in the seated position, or below the hip line in the turtle position. It is to be understood that regardless of the orientation of the dummy, having the knees bent to pass the hip line H and for the knees to be closer to the head, as shown in FIG. 4 allows the grappling dummy 100 to take a realistic and tactically sound lower guard form that would be assumed by a real grappling person. It is also to be understood that bending the knees in such position is possible by flexion to the hip area to allow the upper leg 104A to move in the direction where the head 102 is located to allow the knees to also get closer to the head 102.

Both the upper guard and lower guard positions are simulated by the grappling dummy 100 in the supine position, as shown in FIGS. 1 to 7. In some embodiments, only the upper guard or the lower guards are simulated by the grappling dummy. This also represent realistic grappling forms since in some instances, upper guard is required during grappling, where the elbows and arms are used to create a frame shielding the head 102 and chest area 101 from upright attacks, while the legs are utilized for other purposes. Conversely, in some grappling situations, lower guard position is required, while the arms are utilised for other purposes.

One of the main objectives in grappling is to "pass the guard" of the opponent on bottom. This can be achieved by going around, between, over, or under the legs, in order to pin the bottom grappler's torso to the ground in either Side Control or Full Mount, or get Back Control. Conversely, the bottom grappler is generally looking to "retain his guard" in order to defend and set up attacks. This is generally achieved by keeping one's feet and legs in front of the chest as a barrier to block the top grappler. The arms either extended or bent at the elbow are also commonly used as a secondary barrier to keep the opponent away and offer an opportunity to bring the legs back in. The grappling dummy 100 of the current disclosure clearly shows the configuration described above for establishing a proper guard position, where the arms 103, feet 104 elbows and knees are shown to be above the chest area 101 in the supine position, the knees shown to be above the hip line, elbows are shown to be above and covering the chest areal 101, the combination of which allow for shielding the dummy 100 in the supine position from an upright opponent.

When in the supine position and facing an upright opponent (standing or kneeling), it is imperative for the bottom grappler to point the sole of their feet to the centre of mass of the opponent. The feet are the first barrier employed for guard retention, and will generally allow to control the distance with more power and agility than any other body part. From a fighting perspective, this also allows the person on bottom to attack with a variety of kicks. Grappling dummy 100 in FIGS. 1-7 is shown to simulate such posture. Specifically, feet 105 are shown to be pointing away from the chest area 101 and towards an opponent (not shown) that may be approaching the grappling dummy 100 from the front.

It is known in the grappling art that an upright opponent may try to pass the guard of another grappler in the supine position by attempting to approach from the side to gain access to the chest area. As a defence to this approach, the supine position grappler would block the upright opponent with his knee and reposition his feet to put a distance between the opponent and the grappler's chest area. This realistic and sound tactical defence technique is simulated by the grappling dummy 100, where the leg 104 and hips are bent to simulate a lower guard position. Specifically, FIG. 4 shows the hip area being flexed to allow the upper leg 104 and the knee to form a block to the chest area 101 from a side attack.

The configuration of the grappling dummy 100, as described above, simulates a realistic grappling posture. Specifically, in relation to the chest area 101, given the importance of defending against pins to the upper body, it is usually a grave tactical mistake in grappling to expose one's chest. A savvy opponent will immediately take advantage of chest exposure and secure a guard pass. The grappling dummy 100 addresses this point by providing a proper defensive technique of keeping the knees, feet and arms in front of the chest area 101.

An important goal in grappling is to secure a submission, either in the form of a strangulation or joint lock. In the case of a joint lock, a limb must be isolated and controlled in order to apply breaking pressure on a joint. For this reason, it is generally preferable to keep one's limbs close to one's body and/or to each-other defensively. Unlike many non-mechanical grappling dummies known in the art, grappling dummy 100 is configured to have its default configured posture as a proper, and tactically sound defensive posture with arms 103 and legs 104 close to the chest area 101 and to each other, as described above. With the knees being close or connected to the elbows, this serves both purposes of limiting chest exposure and keeping an opponent away with a sturdy frame, as well as limiting limb exposure by protecting the arms and legs at the same time.

Figure 24:
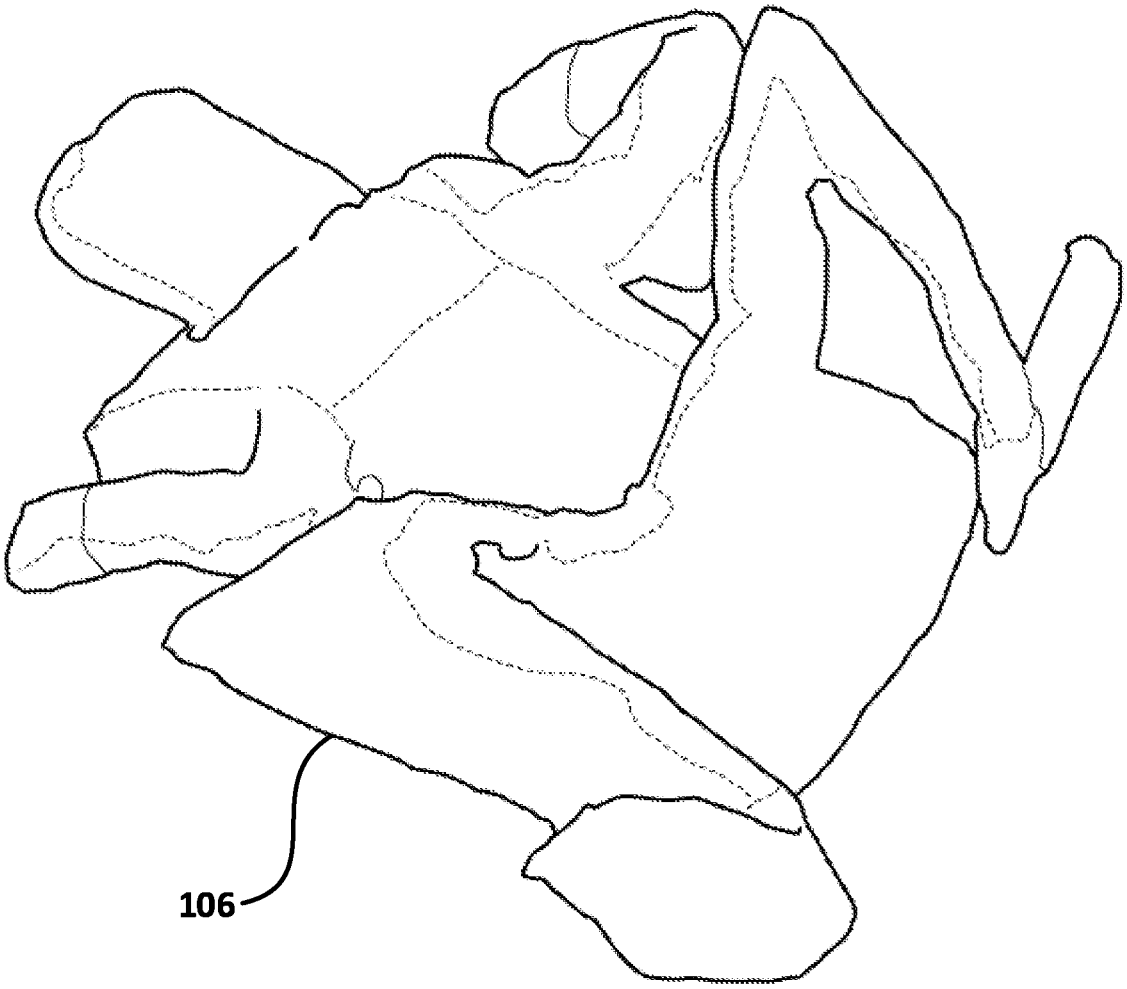
FIG. 24 shows a perspective view of a humanoid shaped envelope in an unfilled configuration for the grappling dummy in accordance with an embodiment of the current invention.

The grappling dummy 100 in FIGS. 1-7 is shown in the filled form. In an unfilled form (FIG. 24), the grappling dummy 100 is composed of a humanoid shaped suit or envelope 106. The envelope 106 of the preferred embodiment is made from heavy-duty VINYL synthetic leather. Such material allows the envelope 106 to retain a predefined shape, when filled, which is the result of textile design and manufacturing. Also, using such type of fabric allows the dummy 100 to be waterproof, which will make it easy to clean and disinfect after use and more durable as it would not absorb moisture. It is to be understood that the aforementioned material is only exemplary and non-limiting and that other material known in the art, of preferable similar characteristics or generally any type of textile, may be used in other embodiment.

In the preferred embodiment, the envelope includes an opening (not shown) in the back of the dummy 100, which allows a point of access to the interior of the dummy 100 to allow for stuffing the grappling dummy 100. The size of the opening is sufficient to allow for inserting fabric and/or stuffing material into all extremities of the envelope 106. It is to be understood that the location of the opening may vary in different embodiments. For example, the opening may be at the chest area, either of the sides, or other location on the envelope 106 as long as such opening allows for a hand of a user to reach, internal to the envelope 106, all extremities defining the limbs to be able to stuff them with fabric and/or stuffing material. The envelope 106 may also include a fastener assembly (not shown) for closing the opening. The fastener assembly may include a zipper, which may be made from any combination of plastic, metal or other material known in the art for supporting a zipper structure and mechanism. In other embodiments, the fastening assembly may include clips, snaps, buttons, laces, hook-and-loop type fasteners, hook-and-eye type fasteners or other type of fasteners and/or fastening mechanisms known in the art. The fastener assembly may be covered to conceal and/or otherwise limit access to the fastener assembly, when the grappling dummy 100 is in use. In the preferred embodiment, the cover 107 is a fabric of the same fabric type as the envelope 106. Velcro (not shown) is provided at the inside of the cover and corresponding section of the envelope 106 to allow the cover 107 to be secured and not to flap during use of the grappling dummy 100.

In some embodiment, the grappling dummy 100 may be sold without an opening to its interior. In such embodiments, the grappling dummy 100 would be filled with fabric and/or stuffing material at the time of manufacturing the envelope 106 such that the stuffed material would be trapped inside the envelope 106 and would not be removable after manufacturing without damaging the exterior layer (i.e. envelop 106) of the grappling dummy 100.

Returning to FIG. 1, in the preferred embodiment, the stitching of the envelope 106 is done using a 4-ply polyester/nylon ultra-strong thread. Also, a reinforced double-stitch technique is used to increase the strength of the stitching. The combination of the material used to make the envelope 106, the type of thread used in the stitching and the stitching technique allow the envelope 106 of the grappling dummy 100 to be durable against physical abuse, especially given that the dummy 100, when filled and in use, will be subject to extensive amount of force applied to various areas of the envelope 106 during training. It is to be understood that other types of thread and stitching techniques known in the art may be used.

While the preferred embodiment is shown to have an envelope 106 made from fabric, it is also to be understood that other material may be used to make the envelope 106, where flexibility, resilience and retainability/retractability of the position of the limbs back to the default position is achieved, when the envelope is filled and in use. Also, in some embodiments, the material that may be used to make the envelope 106 may allow the flexible envelope 106 to be molded rather than stitched. Examples of such material may include any types of flexible plastic or rubber known in the art for such purpose. In such embodiments, it may be possible to avoid the use of treads or stitching techniques in the making of the envelope for the grappling dummy.

Referring back to the envelope 106 of the preferred embodiment, an optional feature of having additional folded fabric in the hips and shoulders may be implemented. Such feature simulates extendable joints to give the grappling dummy 100 more range of motion without risking damage to the fabric, when one or more of the limbs of the dummy 100 are subjected to physical force to bend such limbs.

The envelope 106 of grappling dummy 100 may be filled with any material known in the art for filling martial arts and contact sport training tools or dummies. For example, the grappling dummy in some embodiments may be filled with similar material used to fill a punching bag such as sand, foam or jell material. The grappling dummy 100 may be filled with the same material for all of its parts or may have different material used to fill different parts of the dummy 100. Referring to FIG. 1, grappling dummy 100 is filled with two types of material. Polyester filling is used to stuff the areas for the feet, hands, ankles and wrists. Polyester filling is light in weight and expandable in volume. So, by having the feet and ankles sections filled with such material, this allows for the feet to have a configuration such that they are above the knee line and pointing outward to simulate a realistic lower guard position of a grappler. Similarly, by filling the hands, wrists and sometimes above the wrist area with polyester filling, this would keep the hands from falling down due to gravity in the supine position. Other type of material known in the art with similar characteristics may be used to achieve the same or similar results.

In some embodiment, the fabric may be compactly filled at the joint areas of the grappling dummy 100. Different techniques may be used to achieve this, including applying pressure to the exterior and interior of the envelope 106 at these joint section during the filling process as well as massaging the exterior of the envelope '06 at the joint areas to allow for the fabric or stuffing material to be compactly filled into the joint area of the envelope 106. Such techniques are used to also allow the limbs of the grappling dummy 100 to be flexible about the joints.

Figure 2:
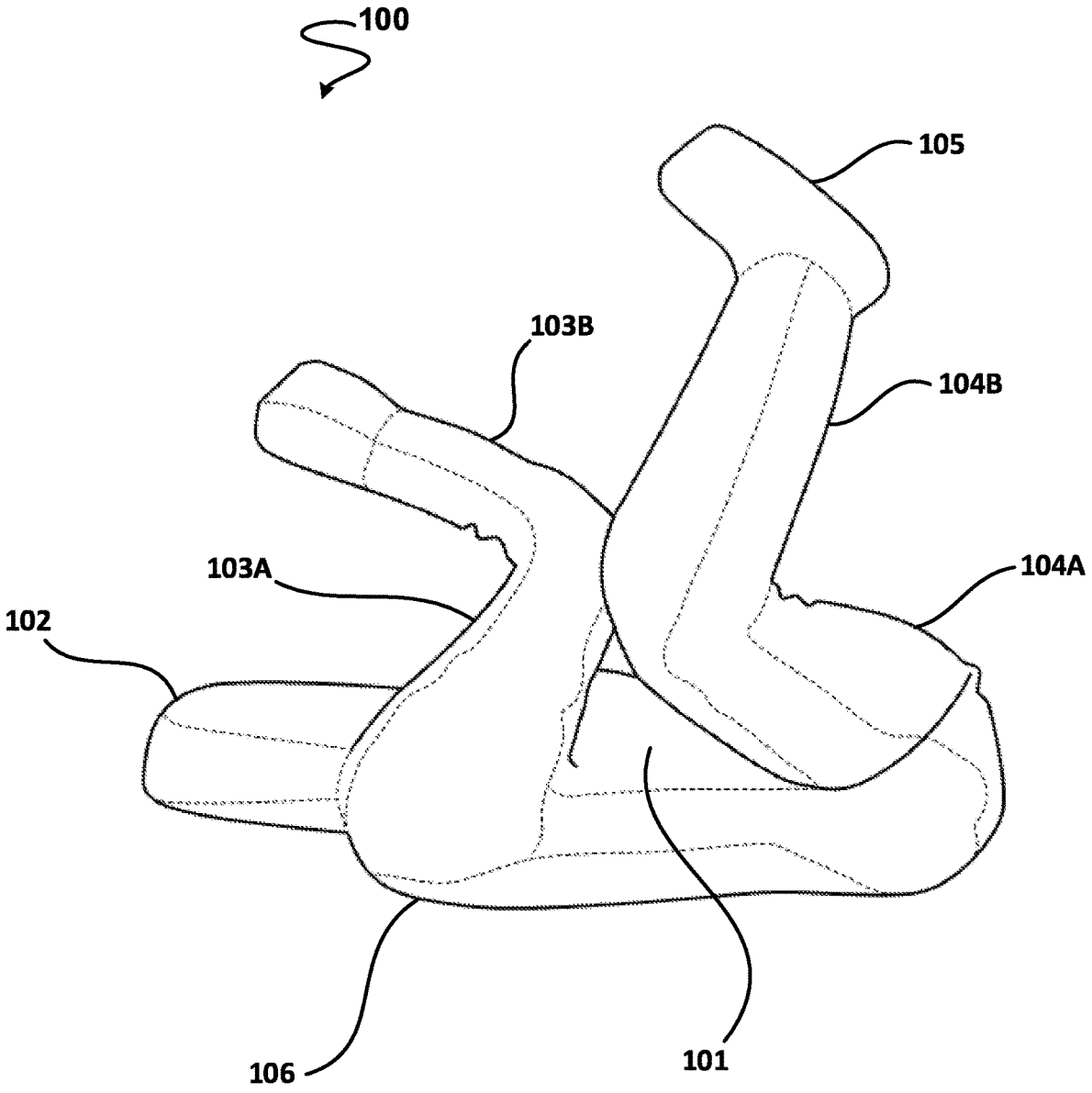
FIG. 2 shows a right-side view of the grappling dummy in FIG. 1.
Figure 3:
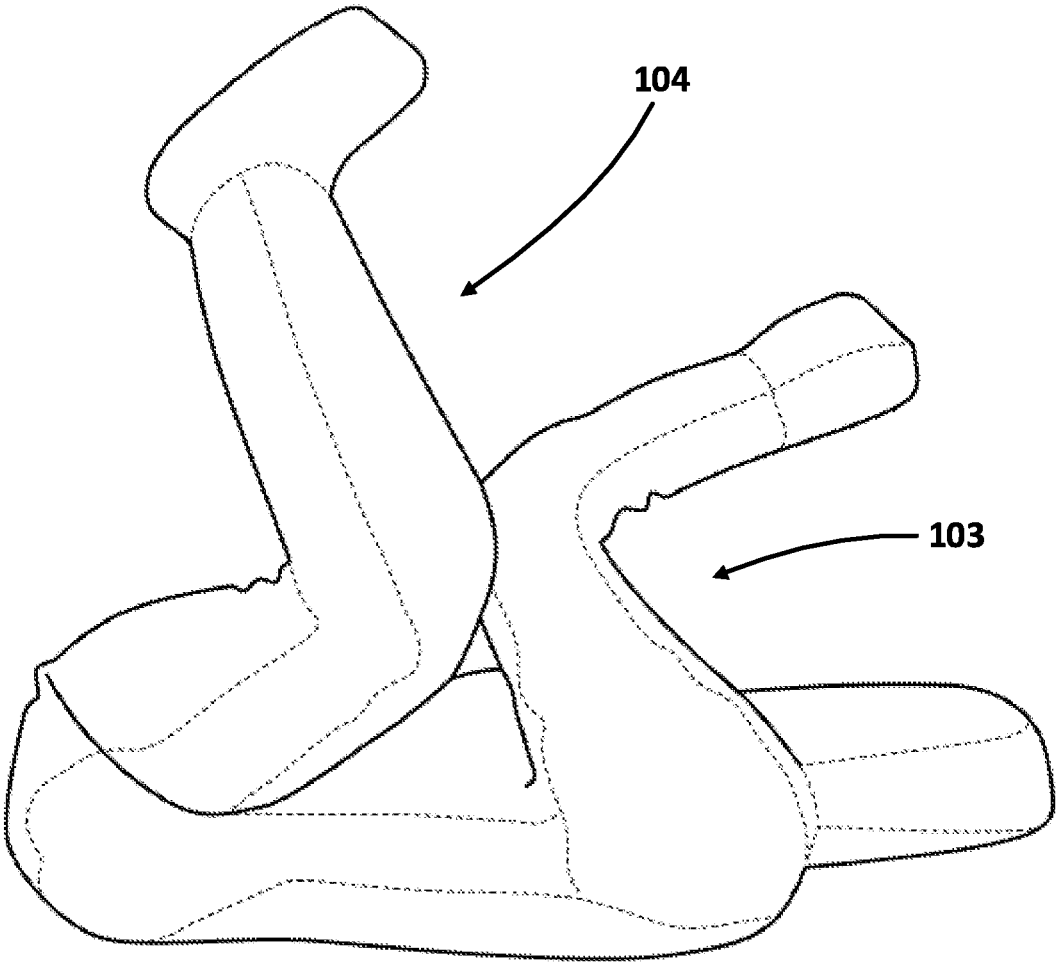
FIG. 3 shows a left-side view of the grappling dummy in FIG. 1

In FIGS. 1 to 3, the elbow and knee sections of grappling dummy 100 are shown to be properly and compactly stuffed and to have roughly a 90 degrees angle in a rest position, when the dummy 100 is placed in the supine position. However, such angle may vary in other embodiments. In FIG. 1, recycled fabric is used to fill in all other parts of the envelope 106 to achieve the form of grappling dummy 100. It is to be understood that in some embodiments, fabric or other stuffing material may be used to fill all parts of the envelope uniformly. In such circumstances, the hands and feet would still hold a realistic upper and lower guard due to the type of material used to fabricate the envelope of the grappling dummy and the design into which the material is fabricated. However, in such embodiments, the degree the arms and feet would be raised in the air would be less by comparison in relation to the preferred embodiment of grappling dummy 100, as shown in FIG. 1

The grappling dummy 100 may have different sizes to match the trainee's size. So, a largely built trainee may opt for a large size grappling dummy, while a medium or small sized trainee may opt for using a medium or small size grappling dummy. It is to be understood that the sizes mentioned are only exemplary and are not intended to limit the scope of the invention. The grappling dummy 100 may be made in many sizes including but not limited to the three sizes described above. Depending on the size of the dummy and the type of material used for the filling, the weight of the grappling dummy may vary from one embodiment to another.

The limbs of grappling dummy 100 are flexible. This may be seen from at least FIGS. 22 and 23, which show the arm 103 and the leg being bent from its rest position. The degree of flexibility of the limbs in grappling dummy 100 substantially correspond to the flexion and expanding of the same limbs in human anatomy. Such correspondence relates to both the amount the limbs can be bent as well as the direction (angle) of flexing such limbs. It is to be understood that depending on the embodiment, some joints may offer more or less range of motion than the corresponding joint in the average human. In some embodiments such as the preferred embodiment, the elbows and knees may be extended past the normal breaking point of the corresponding human joints. Such feature provides a significant advantage over a mechanical dummy, where the joints are mechanical. In such dummies, bending the elbows and/or knees beyond a point, that is usually simulated to be a breaking point of a joint in a human, would cause the mechanical parts to break or fail. A trainee using the mechanical grappling dummies would always be mindful to avoid applying such strength to avoid damaging the mechanical dummy. Such limitation is not present in grappling dummy 100. Since grappling dummy 100 does not have any mechanical parts in the elbows and knees, the trainee would be able to practice joint lock techniques without holding back. It is to be understood that in some embodiments, the type of material used to fabricate the envelope 106 may add a limitation to the amount of force and the degree of flexion of bending that may be applied to the limbs and joints of grappling dummy 100.

Figure 22:
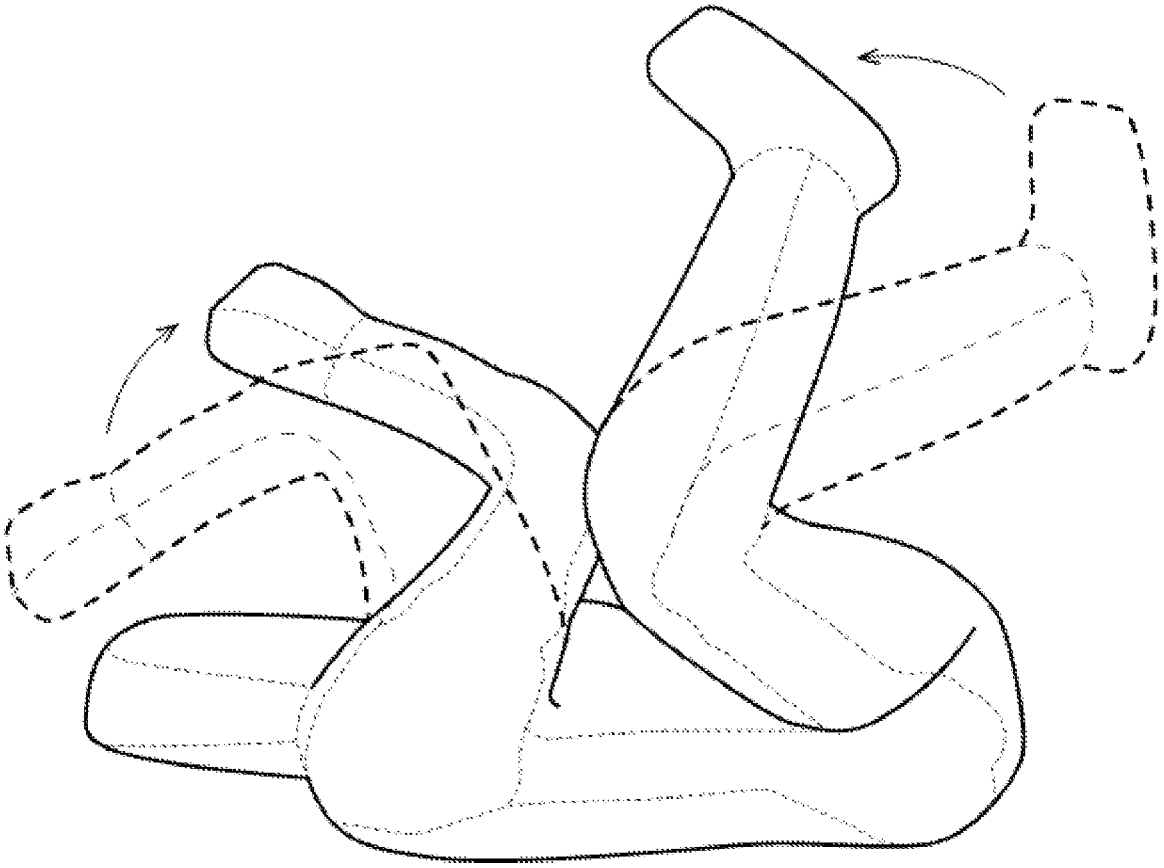
FIG. 22 shows a side view of the grappling dummy in FIG. 1 with one of the arms and one of the legs extended in one orientation from their resting position.
Figure 23:
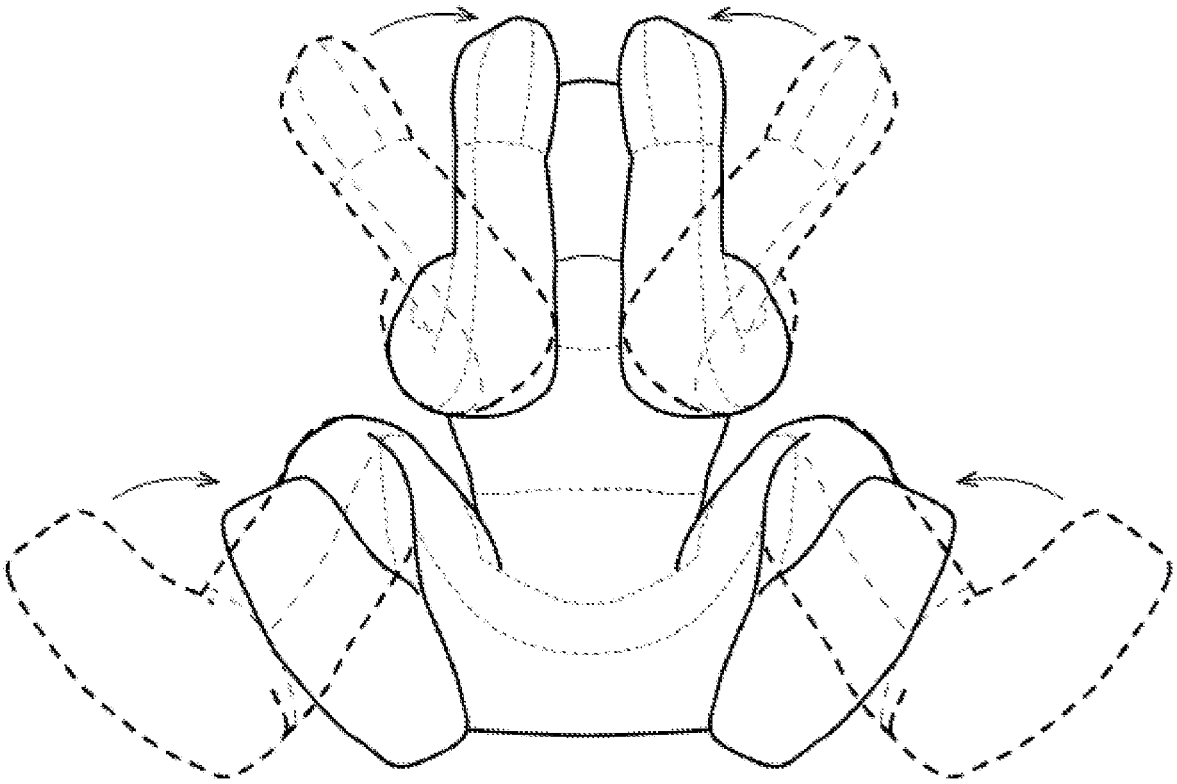
FIG. 23 shows a front view of the grappling dummy in FIG. 8 with the arms and the legs bent in one orientation from their resting position.

FIGS. 22 and 23 show the flexibility of the limbs in exemplary embodiments. In FIG. 22, one arm 103 is shown to be expanded above the head 102 and one leg 104 is expanded down away from the torso 101. FIG. 23 shows another example, where the arm 103 and leg 104 are flexed outwardly away from the torso 101. It is to be understood that the flexion shown in the figures is only exemplary and not limiting. For example, grappling dummy 100 allows for flexion of the arms inwards towards or outwards away from the torso. In general, the limbs and joint areas of grappling dummy 100 may be flexed and bent in many ways. By way of non-limiting examples, the hip may be extended, moving the knee away from the chest and slightly below the hip line. Also, it is possible to manipulate the grappling dummy 100 to show a full flexion of the knee (bringing heel to buttocks) as well as full extension of the knee (making the leg straight). The same for the shoulders, where the grappling dummy 100 may be manipulated to extend the elbow outside away from the chest, and flex inward to place the biceps across the neck. For the elbow, it is possible to apply full flexion bringing the hand to the shoulder and extension to make the arm straight.

As the grappling dummy 100 has a humanoid form, it is flexible in multiple joint areas of interest for grappling. Examples of such joints include wrists, elbows and shoulders that may be focused on by bending sections of the hand, upper and lower arms 103, hip, knees and ankles that may be focused on by bending one or more of the upper leg, lower leg and the foot. In addition, while the head 102 is tilted forward from the plane of the torso, in its resting position, the head 102 is also flexible and resilient to allow for realistic training exercises such as strangling or choke holds.

The limbs of the grappling dummy 100 are formed such that once bent, the limb is resilient to the action of bending. This is show in FIGS. 22 and 23 by the arrow lines, which described that when the arms and or legs are bent into a new position (the dotted line), the arms or legs will retract to their resting position (solid line), which is the guard position. As such, a trainee bending the limb will experience resistance from the dummy 100, which is an expected and realistic reaction from a real grappler. Additionally, once the force used to cause the bending is removed, the limbs are formed to return to their resting position (i.e. retain their resting position or retract to their resting position), which in some embodiments represents the upper guard, lower guard or both. The resilience and retainability of the limbs in grappling dummy 100 are a result of the combination of the type of material used to fabricate the envelope 106 of the grappling dummy 100, the design into which the material is fabricated and the type of material used to fill the envelope. As such, by varying one or more if these factors, it is possible to vary the degree of flexibility and/or the range of motion in different embodiment. For example, in some embodiments, the grappling dummy may be loosely stuffed with filling material to favour flexibility over resilience. Also, it is to be understood that, depending on the three above mentioned factors, flexibility and resilience of the grappling dummy may change for an embodiment over time after some use. This may be due to movement of the stuffing material internally to envelope 106. However, it is possible to regain back the resilience by restuffing the envelope 106 with more filling material.

The flexibility of the limbs in grappling dummy 100 also allows a trainee to use the dummy in an offensive position. One example of such use is to have the grappling dummy 100 simulate a strangling hold of the trainee so that the trainee may practice escape techniques. Such strangling hold is possible in the grappling dummy 100 by bending both arms 103 of the dummy to position them in a way to hold the head and neck of the trainee in a strangling position. In such position, the strangling hold simulated by the dummy 100 will be realistic since the trainee will continue to experience strangling pressure due to the resilience of the arms 103 to return to their resting positions as long as the head and neck of the trainee are positioned in the strangling hold of the grappling dummy 100. Another example, where the grappling dummy 100 may be used to provide a realistic attack (or counterattack) reaction is when the grappling dummy 100 catches the trainee in a half-guard while the trainee practices top control techniques.

The combination of the type of material used to fabricate the envelope of the grappling dummy 100 and the design into which the material is fabricated as well as the material used for filling the envelope to form the grappling dummy allows the humanoid dummy to hold a realistic guard position, provide resilience to any force applied by the trainee to offset that realistic guard position and revert to such position once the force by the trainee is removed, all without the use of any internal or external mechanical parts. Such simulation of movement and reactions of the grappling dummy 100 resemble those of a real grappling opponent. Also, as the grappling dummy 100 lacks mechanical parts and because of its overall exterior shape, it is rollable. As such, the grappling dummy 100 provides an advantage in practicing grappling techniques such as rolling entries.

Grappling may be generally divided into top and bottom positions, with many possible relative engagements in each situation. It is generally considered preferable to be on top, although a good grappler may be very proficient from bottom. A proper grappling or fighting training regimen should cover both situations in depth. The grappling dummy 100 described in FIGS. 1 to 21 allows a trainee or practitioner to do so, due to the sound defensive posture held by the dummy 100. A non-exhaustive list of techniques and situations a practitioner may practice using the grappling dummy, along with how the design of the grappling dummy 100 enhances the realism in training will now be described.

A grappler is considered on bottom position when either the grappler's hips are touching the ground, and/or the majority of the opponent's body is of higher elevation. The three bottom postures are Supine, Seated, and Turtle, with some variations for each. In the Supine position, training may be broadly divided into situations when engaging the guard of grappling dummy 100, whereby the practitioner is generally in front of the legs, or situations when one has already passed the guard, commonly referred to as "top control".

For guard passing vs. the Supine position, grappling dummy 100 offers the primary advantage of having its feet 105 pointing upwards and knees close to the chest 101, which gives the practitioner the opportunity to engage in grip fighting sequences in an effort to displace the feet and knees, thus clearing the way for a guard pass, as they would against a live human training partner. In this situation, the practitioner may also elect to practice various leg entries, back takes, as well as striking techniques from the top, commonly referred to as "ground & pound". Other non-mechanical dummies do not offer nearly as much possibilities for training in the Supine position, since the feet in such dummies are generally resting on the floor, which eliminates the possibility for engaging in grip fighting with the feet, unless the practitioner holds them up, which is quite unrealistic.

When in Top Control, the practitioner may engage in positional transitions between Knee on Belly, Side Control, Full Mount, North/South, and Back Control, as well as practice a wide variety of upper body submissions including, but not limited to, Armbars, Shoulder Locks and Strangulations. In this situation, the main advantage of grappling dummy 100 resides in the fact that light pressure will be applied by its knees to push the practitioner forward and/or attempt to catch a leg were it to stray back below the hip line. For this reason, the practitioner will be reminded to exercise tighter positional control, again enhancing the realism of the training. Other non-mechanical dummies do not offer this positional awareness, and simply lay flat, which is akin to training with a flaccid corpse. Furthermore, given the position of the elbows in front of the body, while covering the chest 101, and pointing downwards towards the knees, the practitioner will need to actively control the arm's angular positioning to complete Armbars, and the arms 103 will also generally come back to their position once extended. A competent human grappler would also generally try to retract their arm when facing the threat of a submission, which is again another great advantage of grappling dummy 100 over other non-mechanical dummies. Other non-mechanical dummies have either very loose shoulder joints that allow for great mobility, but no firmness in the position of the arm and no possible retraction, or make the mistake of flaring the elbows outwards, which a competent grappler would never do. In both cases, these configurations are much less realistic.

A seated position is defined as sitting on the buttocks with the spine vertical or slightly leaning forward with legs extended or soles of the feet together in a butterfly position. When facing a seated opponent, a grappler's main objective will be to put the bottom practitioner on their back. To do so, they may engage in grip fighting sequences with hands to hands or hands to feet, push on the head or shoulders, and couple this with footwork and angles to achieve the desired result. Alternatively, they may also attempt to control the head of the seated opponent, or sometimes transition directly to back control. Flying submissions may also be attempted against a seated opponent, which are executed as some kind of a jump resulting in the attacker landing in a position ready to finish a submission in the form of a joint lock or strangulation.

The main advantage of grappling dummy 100 in the Seated position is its ability to be stable, due to the configuration of the legs. Other non-mechanical dummies generally fall backwards when placed in the seated position, because the knees are too far from the chest. This would force the practitioner to artificially hold the dummies upright in order to execute any technique. As such, the use of such non-mechanical dummies results in unrealistic training. Furthermore, the position of the elbows in front of the body, while covering the chest 101, and pointing downwards places the hands in a favourable and tactically sound grip fighting position, and contributes to protect both chest exposure and limb exposure. Were they are able to actually hold the seated position, other non-mechanical dummies would not offer nearly as much realism with the positioning of their arms, as they would fall to the sides, or flare the elbows, both of which are considered grave tactical mistakes.

The Turtle position is defined as resting face-down, on the knees and elbows with forehead to the ground, limbs curled up, and hips low. The Turtle is a defensive posture adopted from bottom position, mainly when in imminent danger of having one's guard passed. It is often considered as the last stage of guard retention. From the top, the practitioner may engage in Front Headlock attacks comprised mainly of the Guillotine Strangle (amongst others), back takes which in turn lead to a variety of submissions, the most notorious of which being the Rear Naked Strangle (or Rear Naked Choke), or simply control the position and execute ground & pound striking attacks. Breakdowns are also possible to put the bottom practitioner on their back and thus progress to the Top Control situation mentioned above.

The main advantage of grappling dummy 100 in the Turtle position is the fact that it can actually hold a Turtle position. Having its knees above the hip line and sufficiently wide, with elbows in front of the body, while covering the chest 101, the limbs can serve as a sturdy base to support the body. Other non-mechanical dummies simply lay flat on their bellies when face down, because the knees are too far from the chest. Most do not have the ability to post on the elbows either, given the flaccid nature of the shoulders. If such non-mechanical dummies have the ability to post on their knees and hands, the chest is usually wide open, making it way too easy to start taking the back by hooking one's feet inside the thighs. A decent grappler would always strive to keep their limbs very tightly packed to defend against attacks in the turtle position. Such feature distinguishes grappling dummy 100 from other non-mechanical dummies know in the field.

The grappling dummy 100 may also be used for training while in the bottom position with the grappling dummy 100 being in the top position. A grappler is considered on top when they have positional dominance over their opponent, with their hips off the ground, and the majority of their body being higher than the other grappler's. The four top positions are Kneeling, Combat Base, Crouching, and Standing, with some variations for each. The top position offers the advantage of gravity for control or strikes, as well as mobility when on one's feet. It does require more balance though, as the bottom fighter will generally be trying to reverse the situation through off balances and sweeps.

Grappling dummies are by nature inanimate, so practicing from bottom with them on top is generally more challenging than when they are on bottom, regardless of the design. They do not have the ability to regain their balance and will generally fall over quite easily. For this reason, a harness (not shown) may be provided, where such harness is made to fit the grappling dummy 100. Such harness may be configured to hold the grappling dummy 100 up to maintain the top position during training. Alternatively, it may be possible for the practitioner to stabilize the grappling dummy 100 in a variety of ways to execute their techniques. Any harness known in the art may be used to achieve this functionality. A non-limiting example of a harness that may support the grappling dummy 100 in such position for optimal training and safety may include any combination of: heavy-duty, 2-inch, tensilized polyester straps, reinforced Box-X stitching using 4-ply polyester-nylon thread, double, secure D-Rings in optimal placement for a realistic forward-leaning position, and convenient rotational control, Quad-Strap technology to effectively support all the weight of the grappling dummy 100 plus impact stress, and safely protect the waist and hip seams of the grappling dummy 100 due to leg support, and easy installation and removal.

Another possible position the grappling dummy 100 may be used in is a kneeling position, which is defined as an upright position resting on the knees and ankles or toes. Whereas grappling dummy 100 may not hold a kneeling position entirely on its own (apart from being assisted by the harness), this position may be achieved when the practitioner on bottom simply lifts the upper body off the ground. In this situation, the practitioner on bottom may be seated or supine to practice a wide variety of different guards and transitions between them. Some examples include closed guard, half-guard, butterfly guard, etc. In both seated or supine positions, the practitioner on bottom may practice a wide variety of sweeps (reversals), back takes, leg entries leading to leg locks, as well as upper body submissions. Additionally, in supine, the practitioner may rehearse escaping bottom pins such as Side Control and Full Mount.

The main advantage of grappling dummy 100 in the top Kneeling position is its tendency to lean forward and regain the elbow to knee connection. This light forward pressure forces the bottom practitioner to have adequate frames in place to control the distance, which is of great importance when fighting from bottom. Additionally, the close position of the elbows to the knees is what allows grappling dummy 100 to effectively control the hips and upper body of the practitioner when on top, either in or past the guard, which makes practicing escaping the bottom position much more realistic. Other non-mechanical dummies do not offer this elbow to knee connection, and thus are unable to wedge an opponent in place from the top.

Another possible position the grappling dummy 100 may be used in is combat base position, which is defined as an upright position with one knee on the ground and one leg up with the sole of one foot on the ground. The Combat Base position is very similar to Kneeling in terms of the possibilities for training but offers the added benefit of making it harder to wrap the legs around the torso 101 from bottom, which should indeed prove challenging when facing a decent grappler. Furthermore, this position also allows for attacks involving the extension of one leg such as leg lock entries and off-balances. The main advantage of grappling dummy 100 in this position is the fact that it has the ability to bring one leg up due to the configuration of the knees. Other non-mechanical dummies with their knees far from the chest do not have the ability to hold this position.

Another possible position the grappling dummy 100 may be used in is the Crouching position, which is defined as an upright position on both feet while keeping the hips very low and close to or connected to the heels. The Crouching position allows the practitioner on bottom to easily pick up the weight of grappling dummy 100 and balance it over him in order to proceed to a wide variety of sweeps, leg entries for leg locks, back takes, or upper body submissions. The main advantage of grappling dummy 100 in this situation is again the angle of the hip joint and position of the knees and elbows, which offer a realistic barrier to overcome in order to secure attacks. It would be a grave tactical mistake to fall "belly first" on a skilled grappler, which is something observed in other non-mechanical dummies.

Another possible position the grappling dummy 100 may be used in is a standing position, which is defined as an upright position on both feet with legs slightly bent. Although grappling dummy 100 does not stand on its own unless assisted by the harness, it can stay upright with legs half extended if the practitioner balances it over him. This allows the practitioner to practice framing using predominantly the feet and the hands, which is an essential skill for managing the distance and guard retention. The assisted standing position also allows for the practice of many different guards which involve control of the legs, as well as all the same attacks in the form of sweeps, leg entries, back takes, and upper body submissions.

The main advantage of grappling dummy 100 in the standing position is again the shape of the legs, which offer a realistic athletic position one would adopt when standing in a fighting context. Most non-mechanical dummies known in the field would either fall systematically to their knees, or stand with the legs completely straight. Both of these positions are considered grave tactical mistakes when facing a skilled opponent. It is also worth noting that when supporting grappling dummy 100 in the standing position using the harness or other means, this allows for many more dynamic entries into leg attacks from bottom position. It also allows for practicing Wrestling entries. Further, such position of the grappling dummy 100 may allow the practitioner to practice Striking as the grappling dummy 100 may be used as a punching bag. Other non-mechanical dummies known in the art would not offer the same level of realism for wrestling and striking defense, given the configuration of the legs and placement of the arms in such dummies.

In some instances, grappling dummy 100 may be clothed with any fighting suits known in the field. Such configuration may allow the practitioner or trainee to practice different grabbing and throwing techniques utilizing a jacket section of the suit, in which grappling dummy 100 is suited.

Thus, the current disclosure provides non-mechanical, humanoid shaped, grappling dummy that simulates realistic training by holding a proper, sound and realistic guard position and by providing a realistic reaction to bending of its limbs during grappling, such that resilience is experienced against any force of bending and the limbs retract back to retain their relative resting positing once the force of bending is removed. The disclosed grappling dummy provides technical advantage over other non-mechanical dummies known in the art. It also provides an alternative to mechanical dummies with an advantage of not having to maintain any mechanical elements or fix such mechanical parts when broken. Further, with no mechanical parts, the disclosed grappling dummy provides cost advantage in manufacturing over its mechanical counterparts and hence reflects a cost saving for the consumer.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", "upper", "lower" and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a module, assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of device and method have been described herein for purposes of illustration. These are only examples. The technology provided herein can be applied to device and method other than the examples described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A humanoid shaped grappling dummy envelope for martial arts training, the humanoid shaped grappling dummy envelope when filled with filling material forms a non-mechanical grappling dummy comprising:

a torso defining a torso plane and a hip line in the torso plane;

a head coupled to the torso, the head being tilted forward in relation to the plane of the torso;

two arms, each of the two arms having an upper arm section extending from the torso, a lower arm section and an elbow between and connecting the upper arm section and the lower arm section; and two legs coupled to the torso, each of the two legs having an upper leg section extending from the torso, a lower leg section having a free end, such that the two legs have independent free ends, and a knee between and connecting the upper leg section and the lower leg section;

wherein the non-mechanical grappling dummy is configured to have a realistic guard position and wherein each of the torso, head, two arms and two legs are flexible, resilient to bending and retract to the guard position after bending.

2. The humanoid shaped grappling dummy envelope of claim 1, wherein the realistic guard position of the non-mechanical grappling dummy comprises one or more of an upper guard position and a lower guard position, wherein the upper guard position is defined by the two arms being configured to be in front of the torso with the elbow for each of the two arms positioned in front of and covering the torso; and wherein the lower guard position is defined by the knee for each of the two legs being configured to be positioned in a plane different from the plane of the torso, with the knees bent to be closer to the head and passing the hip line and with the lower leg section pointing away from the torso.

3. The humanoid shaped grappling dummy envelope of claim 2, wherein the upper guard position of the non-mechanical grappling guard dummy is further defined to have the lower arm section for each of the two arms positioned to cover the torso and the head.

4. The humanoid shaped grappling dummy envelope of claim 2, wherein the upper guard position of the non-mechanical grappling guard dummy is further defined to have the lower arm section for each of the two arms extended away from the torso and towards an opponent.

5. The humanoid shaped grappling dummy envelope of claim 2, wherein the realistic guard position of the non-mechanical grappling dummy comprises the upper guard position and the lower guard position, wherein the elbows for the two arms define a first length between them and the knees of the two legs define a second length between them and wherein the second length is longer then the first length.

6. The humanoid shaped grappling dummy envelope of claim 5, wherein for each side of the grappling dummy, the elbow is close to the knee.

7. The humanoid shaped grappling dummy envelope of claim 5, wherein for each side of the grappling dummy, the elbow is in contact with the knee.

8. The humanoid shaped grappling dummy envelope of claim 1, wherein the non-mechanical grappling dummy maintains a stable guard posture in any one of a supine position, a seated position and a turtle position.

9. The humanoid shaped grappling dummy envelope of claim 1, wherein the filling material for filling at least part of the lower arm section for each of the two arms and at least part of the lower arm section for each of the two legs is of light weight and expandable characteristics.

10. The humanoid shaped grappling dummy envelope of claim 9, wherein the filling material for filling all other parts of the non-mechanical grappling dummy is of different characteristics than the material for filling the at least part of the lower arm section for each of the two arms and the at least part of the lower leg section for each of the two legs.

11. The humanoid shaped grappling dummy envelope of claim 1, wherein the filling material for filling all parts of the non-mechanical grappling dummy is the same material.

12. The humanoid shaped grappling dummy envelope of claim 1, wherein the two arms, two legs, head and torso are configured to have a range of motion and flexibility corresponding to a natural person.

13. The humanoid shaped grappling dummy envelope of claim 2, wherein the elbow for each of the two arms and the knee for each of the two legs are configured to be resiliently expanded past a normal breaking point of a corresponding human joint.

14. The humanoid shaped grappling dummy envelope of claim 1 further comprising an opening, wherein the humanoid shaped grappling dummy envelope is filled with the filling material through the opening, wherein each part of the humanoid shaped grappling dummy envelope is fillable with filling material through the opening.

15. The humanoid shaped grappling dummy envelope of claim 14 further comprising an assembly for closing the opening, the assembly comprising at least one of covered clips, snaps, buttons, laces, hook-and-loop type fasteners, hook-and-eye type fasteners.

16. A method of making a grappling dummy for martial arts training, the method comprising:

obtaining an envelope having a humanoid shape;

filling the humanoid shaped envelope with filling material; and forming a non-mechanical grappling dummy to have:

a torso defining a torso plane and a hip line in the torso plane;

a head coupled to the torso, the head being tilted forward in relation to the plane of the torso;

two arms, each of the two arms having an upper arm section extending from the torso, a lower arm section and an elbow between and connecting the upper arm section and the lower arm section; and two legs coupled to the torso, each of the two legs having an upper leg section extending from the torso, a lower leg section having a free end, such that the two legs have independent free ends, and a knee between and connecting the upper leg section and the lower leg section; and configuring the non-mechanical grappling dummy to have a realistic guard position, wherein each of the torso, head, two arms and two legs are flexible, resilient to bending and retract to the guard position after bending.

17. The method of claim 16, the method further comprises one or more of:

configuring the two arms to have a resting posting, wherein the two arms are positioned in front of the torso with the elbow for each of the two arms positioned in front of and covering the torso; and configuring the two legs to have a resting position, wherein the two legs are positioned in a plane different from the plane of the torso, with the knees bent to be closer to the head and passing the hip line and with the lower leg section pointing away from the torso.

18. The method of claim 17, the method further comprising: filling at least part of each of the two lower arms and at least part of each of the two lower legs with filling material having a light weight and expandable characteristics.

19. The method of claim 16, the method further comprising: configuring the two arms, two legs, head and torso to have a range of motion and flexibility corresponding to a natural person.

20. A method of training in martial arts, the method comprises:

obtaining a non-mechanical grappling dummy as described in claim 1;

positioning the non-mechanical grappling dummy in any one of a supine, a seated or a turtle positions; and using the non-mechanical grappling dummy to practice realistic grappling techniques.

* * * * *